US006813850B2

(12) United States Patent
Greenwood

(10) Patent No.: US 6,813,850 B2
(45) Date of Patent: Nov. 9, 2004

(54) CONTINUOUS DITCH EXCAVATOR

(76) Inventor: Todd H. Greenwood, 1959 N. Peace Haven Rd. #179, Winston-Salem, NC (US) 27106

( * ) Notice: Subject to any disclaimer, the term of this patent is extended or adjusted under 35 U.S.C. 154(b) by 0 days.

(21) Appl. No.: 10/201,376

(22) Filed: Jul. 23, 2002

(65) Prior Publication Data

US 2004/0016152 A1 Jan. 29, 2004

(51) Int. Cl.[7] ..... E02F 5/02
(52) U.S. Cl. ..... 37/348; 37/350; 37/417
(58) Field of Search ..... 37/348, 350, 417, 37/347, 412, 432, 189, 462, 464; 405/174, 179, 154.1; 171/116, 244

(56) References Cited

U.S. PATENT DOCUMENTS

| | | | | |
|---|---|---|---|---|
| 82,846 | A | | 10/1868 | Jones |
| 328,407 | A | | 10/1885 | Humphrevs |
| 363,560 | A | | 4/1887 | Stewart |
| 574,660 | A | | 1/1897 | Carroll |
| 606,987 | A | | 7/1898 | Clark |
| 1,071,477 | A | | 8/1913 | Stowe |
| 1,405,256 | A | | 1/1922 | Bates |
| 2,048,710 | A | | 7/1936 | Ranney |
| 2,545,016 | A | | 3/1951 | Berry |
| 3,075,658 | A | | 1/1963 | Neighbour |
| 3,130,506 | A | | 4/1964 | Laster |
| 3,257,662 | A | | 6/1966 | Smith |
| 3,290,804 | A | | 12/1966 | Hanson |
| 3,406,767 | A | | 10/1968 | Watts |
| 3,443,326 | A | | 5/1969 | Saumenig |
| 3,646,767 | A | | 3/1972 | Shelley |
| 3,813,171 | A | | 5/1974 | Teach et al. |
| 3,893,302 | A | | 7/1975 | Peterson |
| 3,896,570 | A | | 7/1975 | McMurray |
| 3,903,624 | A | | 9/1975 | Holl |
| 3,934,363 | A | | 1/1976 | McMurray |
| 4,098,012 | A | | 7/1978 | Parrish |
| 4,395,158 | A | | 7/1983 | Brooks |
| 4,751,971 | A | | 6/1988 | Thompson |
| 4,872,275 | A | | 10/1989 | Beckett et al. |
| 5,033,214 | A | * | 7/1991 | Kaczmarski et al. ..... 37/350 |
| 5,462,122 | A | | 10/1995 | Yamamoto et al. |
| 5,764,511 | A | | 6/1998 | Henderson |
| 6,220,786 | B1 | | 4/2001 | Ollason et al. |
| 6,305,879 | B1 | | 10/2001 | Greenwood |
| 6,571,492 | B2 | * | 6/2003 | Greenwood ..... 37/348 |

* cited by examiner

*Primary Examiner*—Thomas B. Will
*Assistant Examiner*—Meredith Petravick
(74) *Attorney, Agent, or Firm*—Adams Evans PA

(57) ABSTRACT

A continuous ditch excavator includes an excavating auger rotatably mounted on a chassis in a centrally-disposed excavation work area defined by forward and rear portions. Two driving elements are rotatably-mounted in laterally spaced-apart relation to each other on the chassis. The auger is moved laterally between the first and second driving elements to permit adjustment of the position of the auger in relation to the first and second driving elements. In another embodiment, the auger is carried by an arm rotatably mounted to the chassis. In yet another embodiment, the excavator includes a plurality of excavating augers independently raised and lowered to vary the width of the ditch.

23 Claims, 23 Drawing Sheets

60
61
62A
62B
63
66
L
R

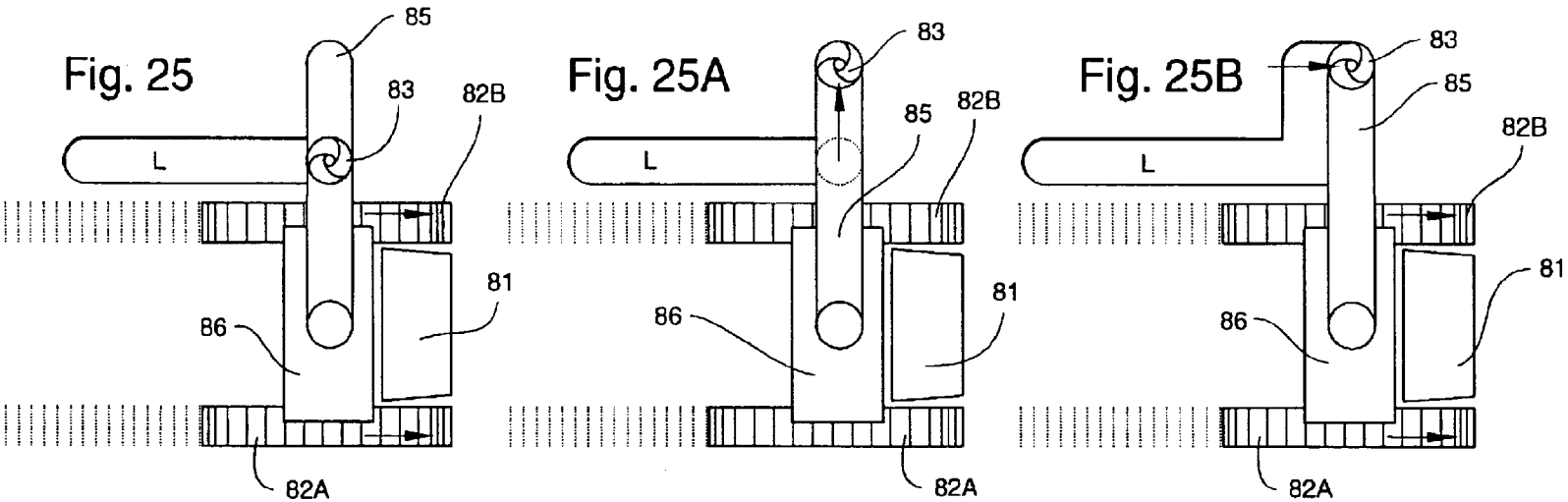
Fig. 25
Fig. 25A
Fig. 25B
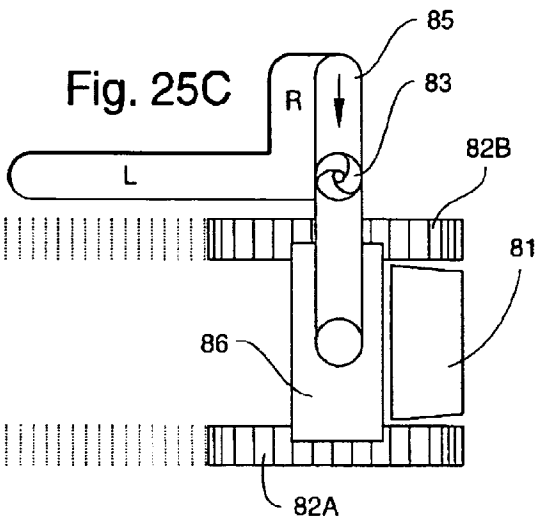
Fig. 25C
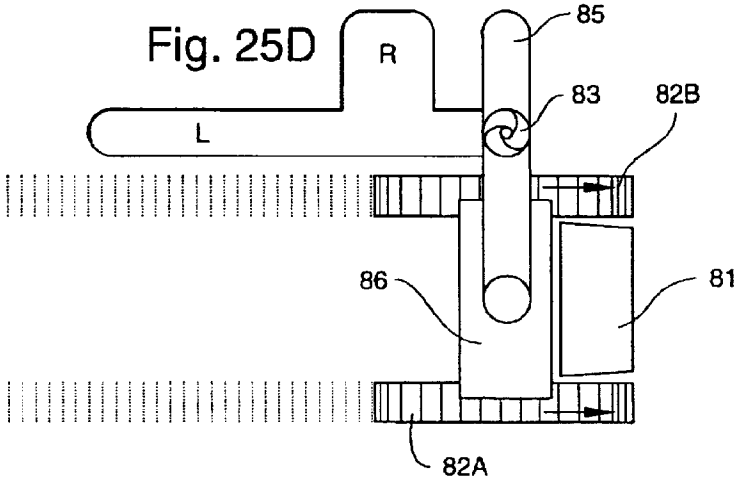
Fig. 25D

CONTINUOUS DITCH EXCAVATOR

TECHNICAL FIELD AND BACKGROUND OF THE INVENTION

This invention relates to a continuous ditch excavator. Many types of development projects, including residential and commercial construction and irrigation, as well as underground utility installation involving the burying of pipe or conduit, involve ditch excavation. Such ditches must frequently be angled and/or curved in order to stay within the confines of the property owned by the person authorizing the excavation or to avoid encountering natural and artificial barriers such as waterways, desired wooded areas, and preexisting underground utility installations. In addition, it is often necessary to excavate spread-footing formations, in which rectangular segments extend outward from the continuous linear ditch, for placement of column supports for buildings.

In the past, backhoes have typically been used to dig ditches. However, the motion of the backhoe arm on which the digging bucket is mounted creates undulations at the base of the ditch. In addition, the sides of the ditch are slightly widened each time the bucket enters the ditch, resulting in waste. Furthermore, the extent of these imperfections can vary greatly depending on the level of skill and training of the operating personnel, which is usually a crew of two to three people.

Other prior art devices for ditch excavating typically include augers or other digging implements that are mounted on or near the front of the excavator. This arrangement precludes continuous excavation at corners and curves in the ditch, because such excavators must cease excavation and reorient themselves whenever corners and curves in the ditch are desired. This interruption becomes more and more pronounced as the angle of the turn becomes greater; turns of 90 to 180 degrees are especially troublesome. This problem results not only in temporary work stoppage, but also in potentially inconsistent ditches. The width and depth of the ditch, as well as the pitch of the ditch walls, may vary with each retraction, reorientation, and re-engagement of the excavator at turns in the desired ditch path. In addition, with the necessary reorientation of the excavator comes the risk of misguiding the excavator during reorientation such that the integrity of the portion of the ditch that has already been excavated is compromised or damaged.

The present invention solves this problem by providing a continuous ditch excavator with a substantially centrally-disposed auger that enables the excavator chassis to rotate about the auger, thereby allowing the excavator to make turns at any angle without the need for retracting the auger from the ditch. Such a design ensures ditch consistency and integrity as well as avoidance of work stoppages caused by excavator retraction and reorientation.

SUMMARY OF THE INVENTION

Therefore, it is an object of the invention to provide a continuous ditch excavator that may excavate ditches having corners and curves without having to retract the auger or other digging implement from the ditch.

It is another object of the invention to provide a continuous ditch excavator for efficiently producing spread-footing formations.

It is another object of the invention to provide a continuous ditch excavator that can excavate spread-footing formations without retracting the auger or other digging implement from the ditch.

It is another object of the invention to provide a continuous ditch excavator that increases efficiency by minimizing work stoppages associated with retraction, reorientation, and re-engagement of the excavator at corners and curves in the desired ditch path.

It is another object of the invention to provide a continuous ditch excavator that preserves the integrity of ditch walls.

It is another object of the invention to provide a continuous ditch excavator that accurately maintains ditch width and depth without stopping excavation.

It is another object of the invention to provide a continuous ditch excavator that generally eases and expedites excavation of spread-footing formations.

It is another object of the invention to provide a continuous ditch excavator that produces a ditch having a substantially level base, free from undulations.

It is another object of the invention to provide a continuous ditch excavator that may be operated by one person.

It is another object of the invention to provide a continuous ditch excavator that produces ditches of consistent quality and quantity when operated by persons of varying skill level.

It is another object of the invention to provide a continuous ditch excavator that may be controlled by a human operator from a position either aboard or remote from the excavator, or by automation.

It is another object of the invention to provide a continuous ditch excavator that prevents soil removed from the ground by the auger from falling into the ditch as the auger is raised out of the ditch.

It is another object of the invention to provide a continuous ditch excavator that lays excavated dirt evenly along the ditchline or removes the dirt directly to a vehicle for removal from the site.

It is another object of the invention to provide a continuous ditch excavator that provides a bin for containing soil removed from the ground and means for emptying the soil containment bin when desired.

It is another object of the invention to provide a continuous ditch excavator that produces a ditch adapted for a particular use such as burying a pipeline or water drainage.

These and other objects of the present invention are achieved in the preferred embodiments disclosed below by providing a continuous ditch excavator including a chassis having a forward portion and a rear portion, first and second rotatably-mounted driving elements having treads thereon, the first and second driving elements carried by the chassis in laterally spaced-apart relation to each other for driving and steering the chassis along a ground surface, and the driving elements define a centrally-disposed excavation work area therebetween. An excavating auger is rotatably-mounted on the chassis in the excavation work area forwardly of the rear portion of the chassis, rearwardly of the forward portion of the chassis and intermediate the first and second driving elements for penetrating and excavating a ditch in the ground as the chassis is driven along the ground, and auger positioning means are connected to the auger for moving the auger laterally between the first and second driving elements to permit adjustment of the position of the auger in relation to the first and second driving elements.

According to one preferred embodiment of the invention, the auger defines a pivot point about which the chassis is adapted to pivot to control the direction of ditch excavation.

According to another preferred embodiment of the invention, a containment bin is mounted on the chassis in proximity to the auger for receiving soil removed from the ground by the auger.

According to yet another preferred embodiment of the invention, emptying means are provided adjacent to the containment bin for emptying the contents of the containment bin.

According to yet another preferred embodiment of the invention, the emptying means include a transport auger positioned in communication with the containment bin for moving soil out of the containment bin and depositing the soil at a soil discharge location adjacent to the ditch.

According to yet another preferred embodiment of the invention, the excavator includes a containment shield disposed in a first plane and adjacent to the auger for preventing the soil removed by the auger from falling back into the ditch as the auger is raised out of the ditch.

According to yet another preferred embodiment of the invention, the excavator includes a second containment disposed in a second plane shield that is independently rotatable about the auger and cooperatively positioned to expose a desired area of the auger.

According to yet another preferred embodiment of the invention, the containment shields cooperate with each other to surround approximately two-thirds of the circumference of the auger.

According to yet another preferred embodiment of the invention, the excavator includes a stabilizing bar connected at opposing ends to the containment shield and the auger to stabilize the auger and prevent contact between the auger and the containment shield.

According to yet another preferred embodiment of the invention, the containment shield includes a first shield component proximal the portion of the auger for penetrating the ground and the rear portion of the chassis. The first shield component is an arcuate plate partially surrounding the auger and is rotatable about the auger.

According to yet another preferred embodiment of the invention, the first shield component is positioned opposite to a direction of travel of the auger defined by lateral movement of the auger between the first and second driving elements and movement of the chassis.

According to yet another preferred embodiment of the invention, the first shield component is semi-circular.

According to yet another preferred embodiment of the invention, the containment shield includes a second shield component proximal to the portion of the auger that remains above ground and the forward portion of the chassis. The second shield component is an arcuate plate partially surrounding the auger and preventing soil from entering the forward portion of the chassis.

According to yet another preferred embodiment of the invention, the containment shield includes a middle shield component disposed between the upper and lower shield components and completely surrounding the auger.

According to yet another preferred embodiment of the invention, the continuous ditch excavator includes a chassis having a forward portion and a rear portion, first and second rotatably-mounted driving elements having treads thereon, the driving elements carried by the chassis in laterally spaced-apart relation to each other for driving and steering the chassis along a ground surface, an arm rotatably mounted on the chassis and extending horizontally to a point outside the perimeter of the chassis, and an excavating auger for penetrating and excavating a ditch, the auger rotatably mounted to the arm at a point outside the perimeter of the chassis.

According to yet another preferred embodiment of the invention, the arm is rotatably mounted proximate the center of the chassis and extends horizontally a predetermined length whereby said auger is moveable in a complete circle around chassis.

According to yet another preferred embodiment of the invention, the auger is perpendicular to the arm.

According to yet another preferred embodiment of the invention, the auger is mounted in a vertical position, and the arm is mounted in a horizontal position.

According to yet another preferred embodiment of the invention, the auger is moveable along the length of the arm.

According to yet another preferred embodiment of the invention, the containment shield is positioned opposite to a direction of travel of the auger defined by movement of the arm.

According to yet another preferred embodiment of the invention, the excavator includes first and second containment shields adjacent to the auger for preventing the soil removed by the auger from falling back into the ditch as the auger is raised out of the ditch. The containment shields are independently rotatable about the auger and cooperatively positioned to expose a desired area of the auger.

According to yet another preferred embodiment of the invention, the continuous ditch excavator includes a chassis having a forward portion and a rear portion, first and second rotatably-mounted driving elements having treads thereon, the driving elements carried by the chassis in laterally spaced-apart relation to each other for driving and steering the chassis along a ground surface, the first and second driving elements defining a centrally-disposed excavation work area therebetween; and a plurality of excavating augers rotatably-mounted on the chassis in the excavation work area for penetrating and excavating a ditch in the ground as the chassis is driven along the ground.

According to yet another preferred embodiment of the invention, the plurality of augers are linearly aligned on the chassis laterally between the first and second driving elements.

According to yet another preferred embodiment of the invention, the plurality of excavating augers include a center auger defining a pivot point about which the chassis is adapted to pivot to control the direction of ditch excavation.

According to yet another preferred embodiment of the invention, lift means are connected to the plurality of augers for independently raising and lowering each of the augers. A ditch having a desired width can be excavated by lowering a predetermined number of adjacent augers relative to the desired width into the ground surface to excavate the ditch. A predetermined number of ditches can be simultaneously excavated by lowering an equal number of non-adjacent excavating augers into the ground surface to excavate the predetermined number of ditches.

According to yet another preferred embodiment of the invention, the continuous ditch excavator includes a chassis having a forward portion and a rear portion, rotatably-mounted driving elements having treads thereon, the driving elements carried by the chassis in laterally spaced-apart relation to each other for driving and steering the chassis along a ground surface, the first and second driving elements defining a centrally-disposed excavation work area therebetween. An excavating auger is rotatably mounted on the chassis in the excavation work area forwardly of the rear portion of the chassis, rearwardly of the forward portion of the chassis and intermediate the first and second driving elements for penetrating and excavating a ditch in the ground as the chassis is driven along the ground. The auger defines a pivot point about which the chassis is adapted to pivot to control the direction of ditch excavation. A containment shield is adjacent to the auger for preventing the soil removed by the auger from falling back into the ditch as the auger is raised out of the ditch. A stabilizing bar is connected at opposing ends to the containment shield and the auger to stabilize the auger and prevent contact between the auger and the containment shield during operation.

According to yet another preferred embodiment of the invention, the continuous ditch excavator includes a chassis having a forward portion and a rear portion, rotatably-mounted driving elements having treads thereon, the driving elements carried by the chassis in laterally spaced-apart relation to each other for driving and steering the chassis along a ground surface, the first and second driving elements defining a centrally-disposed excavation work area therebetween. A first auger is rotatably mounted on the chassis in the excavation work area forwardly of the rear portion of the chassis, rearwardly of the forward portion of the chassis and intermediate the first and second driving elements for penetrating a ground surface and excavating a ditch in the ground as the chassis is driven along the ground. The auger defines a pivot point about which the chassis is adapted to pivot to control the direction of ditch excavation. A second auger is positioned on the chassis proximate the first auger for moving soil removed from the ground by the first auger to point outside of the excavator.

A preferred embodiment of the method for excavating a continuous ditch having a first linear segment and a second linear segment extending at an angle from the first linear segment according to the invention includes the steps of providing a continuous ditch excavator having a chassis including a forward portion and a rear portion, first and second rotatably-mounted driving elements having treads thereon, the driving elements carried by the chassis in laterally spaced-apart relation to each other for driving and steering the chassis along a ground surface, the first and second driving elements defining a centrally-disposed excavation work area therebetween, an excavating auger rotatably-mounted on the chassis in the excavation work area forwardly of the rear portion of the chassis, rearwardly of the forward portion of the chassis and intermediate the first and second driving elements for penetrating and excavating a ditch in the ground, and auger positioning means connected to the auger for moving the auger laterally between the first and second driving elements to permit adjustment of the position of the auger in relation to the first and second driving elements. The auger is moved laterally toward the first driving element, lowered into the ground, and rotated to excavate the ground. The chassis is moved forward to excavate the first linear segment in the ground. The chassis is stopped at a predetermined point for excavating the second linear segment. The auger is moved laterally toward the second driving element to excavate the second linear segment at an angle to the first linear segment.

Another preferred embodiment of the method for excavating a continuous ditch having a first linear segment and a second linear segment extending at an angle from the first linear segment according to the invention includes the steps of moving the chassis forward from the second linear segment, and then moving the auger laterally toward the first driving element to form a third linear segment adjacent and parallel to the second linear segment and approximately perpendicular to the first linear segment. The second and third linear segments form a rectangular segment extending from the first linear segment.

Yet another preferred embodiment of the method for excavating a continuous ditch having a first linear segment and a second linear segment extending from the first linear segment according to the invention includes the steps of providing a continuous ditch excavator having a chassis including a forward portion and a rear portion, first and second rotatably-mounted driving elements having treads thereon, said driving elements carried by the chassis in laterally spaced-apart relation to each other for driving and steering the chassis along a ground surface, an arm rotatably mounted on the chassis and extending horizontally to a point outside the perimeter of the chassis, and an excavating auger for penetrating and excavating a ditch. The auger is moveable along the length of the arm and rotatably mounted to the arm at a point outside the perimeter of the chassis. The arm is positioned perpendicularly to the chassis, and the auger is positioned on the arm proximate the chassis. The auger is lowered into the ground and rotated to excavate the ground. The chassis moves forward to excavate the first linear segment in the ground, and stopped at a predetermined point for excavating the second linear segment. The auger is moved along the arm away from the chassis to excavate the second linear segment approximately perpendicular to the first linear segment.

Yet another preferred embodiment of the method for excavating a continuous ditch having a linear segment and at least one rectangular segment extending at an angle therefrom according to the invention includes the steps of providing a continuous ditch excavator having a chassis including a forward portion and a rear portion, first and second rotatably-mounted driving elements having treads thereon, the driving elements carried by the chassis in laterally spaced-apart relation to each other for driving and steering the chassis along a ground surface, the first and second driving elements defining a centrally-disposed excavation work area therebetween, a plurality of excavating augers rotatably-mounted and positioned laterally on the chassis in the excavation work area for penetrating and excavating a ditch in the ground as the chassis is driven along the ground, and lift means connected to the plurality of augers for independently raising and lowering each of the augers. A first auger is lowered into the ground and rotated to excavate the ground. The chassis is moved forward to excavate the substantially linear segment in the ground. The chassis is stopped at a predetermined point for excavating the rectangular segment. A predetermined number of additional augers are lowered into the ground in proportion to a desired area of the rectangular segment. The lowered augers are rotated to excavate the ground. The chassis moves forward to excavate the rectangular segment. Finally, the chassis is stopped at a desired point for ending the rectangular portion and the additional augers are lifted out of the ground.

Yet another preferred embodiment of the method for excavating a continuous ditch having a linear segment and at least one rectangular segment extending at an angle therefrom according to the invention includes the step of moving the chassis forward with the first auger remaining in the ground to continue excavating the linear segment.

BRIEF DESCRIPTION OF THE DRAWINGS

Some of the objects of the invention have been set forth above. Other objects and advantages of the invention will appear as the invention proceeds when taken in conjunction with the following drawings, in which:

FIGS. 25 through 25D are top plan views illustrating a preferred method for using the preferred embodiment shown in FIG. 23;

DESCRIPTION OF THE PREFERRED EMBODIMENT AND BEST MODE

Figure 1:
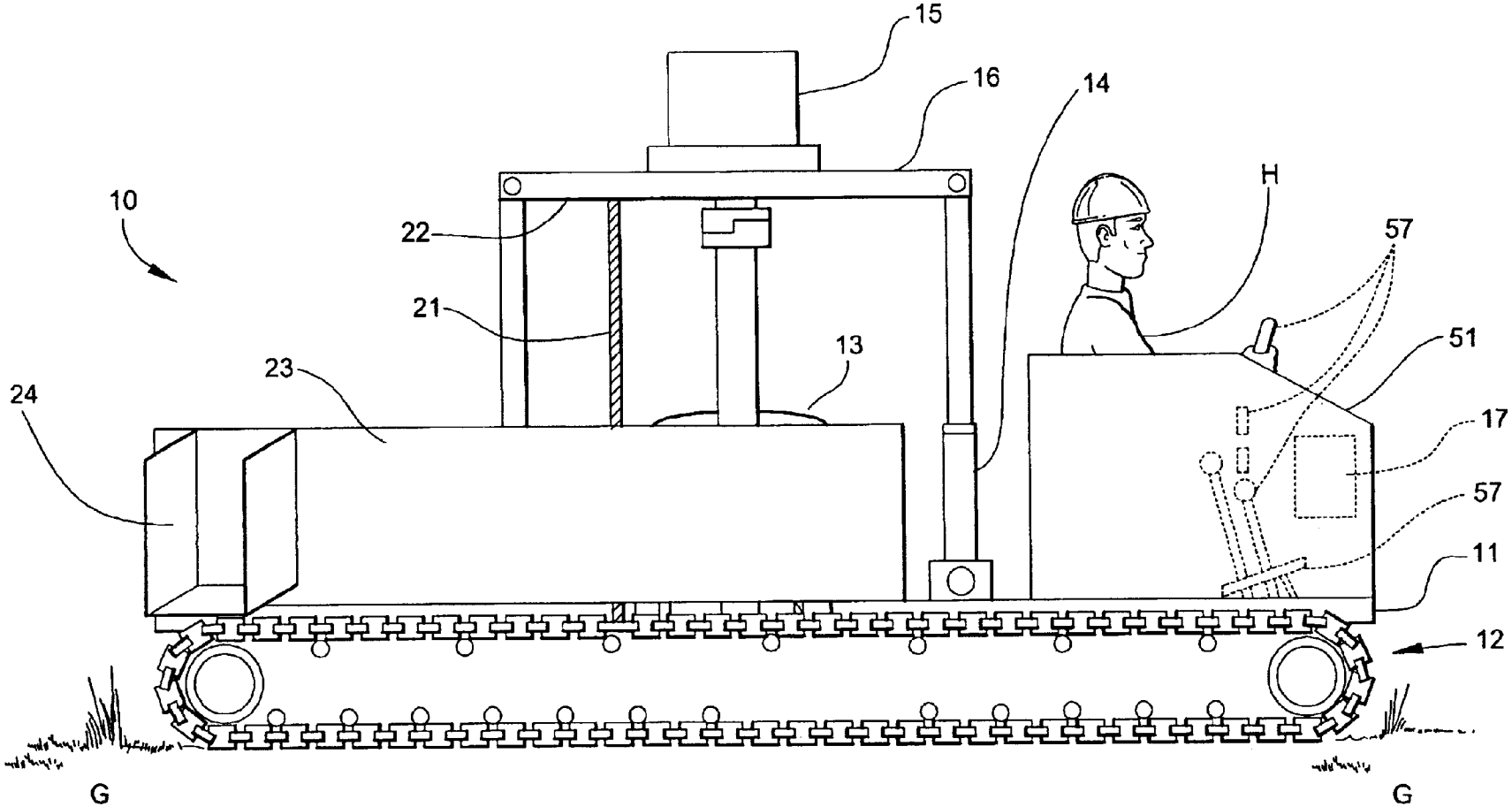
FIG. 1 is a side elevation of a continuous ditch excavator according to a preferred embodiment of the invention, with operator shown.
Figure 9:
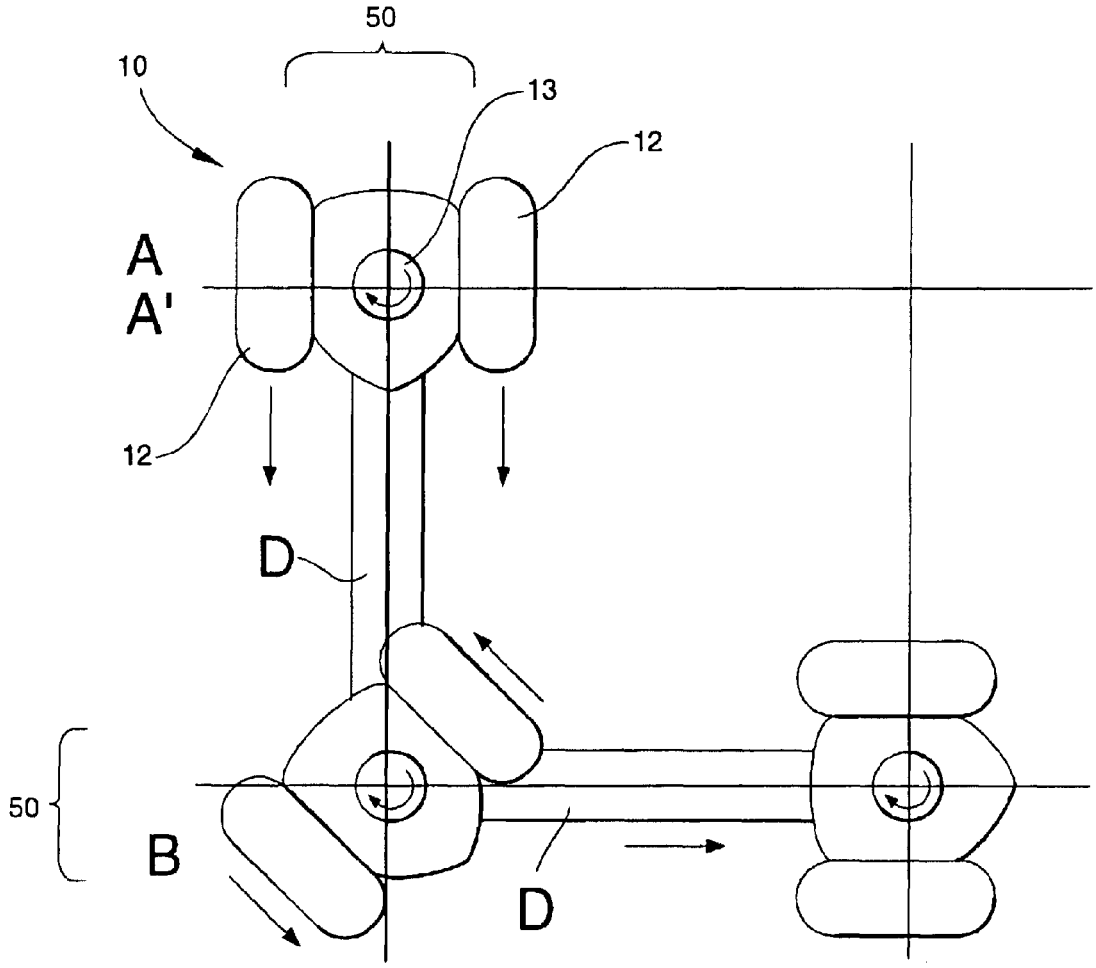
FIG. 9 is a top plan view of a simplified line drawing of a continuous ditch excavator according to a preferred embodiment of the invention showing the excavator at three successive stages of excavation, including the continuous excavation of a 90-degree turn in the ditch path.

Referring now specifically to the drawings, a continuous ditch excavator according to the present invention is illustrated in FIG. 1 and shown generally at reference numeral 10 with a human operator "H" aboard. Most basically, the excavator comprises a chassis 11 and motive means such as caterpillar tracks 12 for moving the chassis 11 along the ground "G". The caterpillar tracks 12 are driven by motor means such as a gasoline engine 17. The motor means driving the caterpillar tracks 12 could instead comprise a diesel engine, an electric motor, or a hydraulic motor. The motive means could instead comprise wheels or moving belts. In a preferred embodiment, a pair of caterpillar tracks (one track shown at 12) are spaced apart to define a central excavation area (FIG. 9, reference numeral 50). To achieve excavation, an auger 13 carried by an auger support 16 is raised, lowered, and rotated within the excavation area (FIG. 9, ref. num. 50) to engage, penetrate, and remove soil from the ground "G" as needed to form a ditch (not shown) of predetermined dimensions. The ditch in the excavation area (FIG. 9, ref. num. 50) is straddled by the caterpillar tracks 12.

Figure 2:
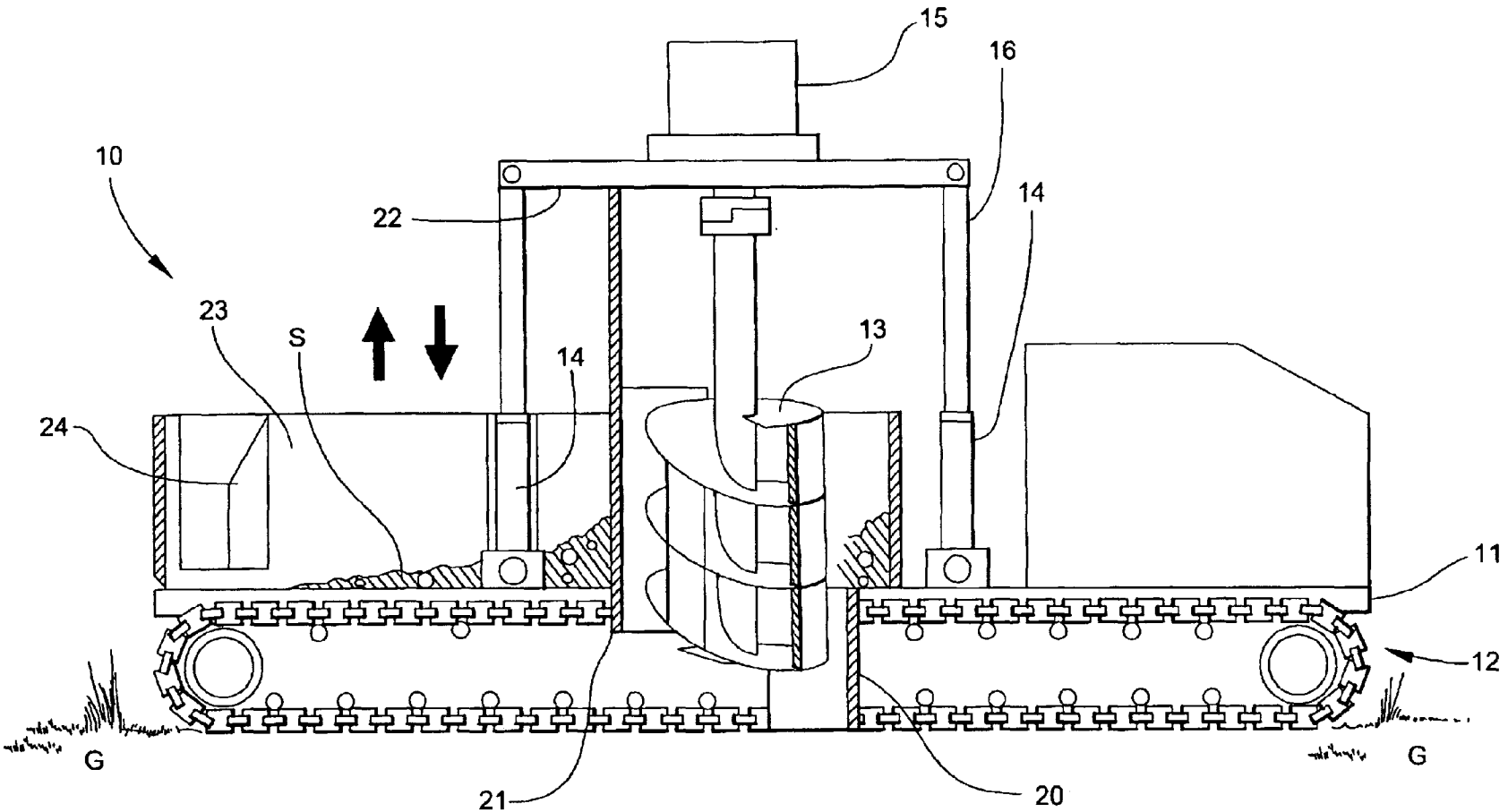
FIG. 2 is a partial cross-section taken generally along the length of a continuous ditch excavator according to a preferred embodiment of the invention in order to illustrate the structure of the internal machinery of the excavator with the auger in a raised position and showing arrows indicating the ability of the lifts to raise and lower the auger.
Figure 3:
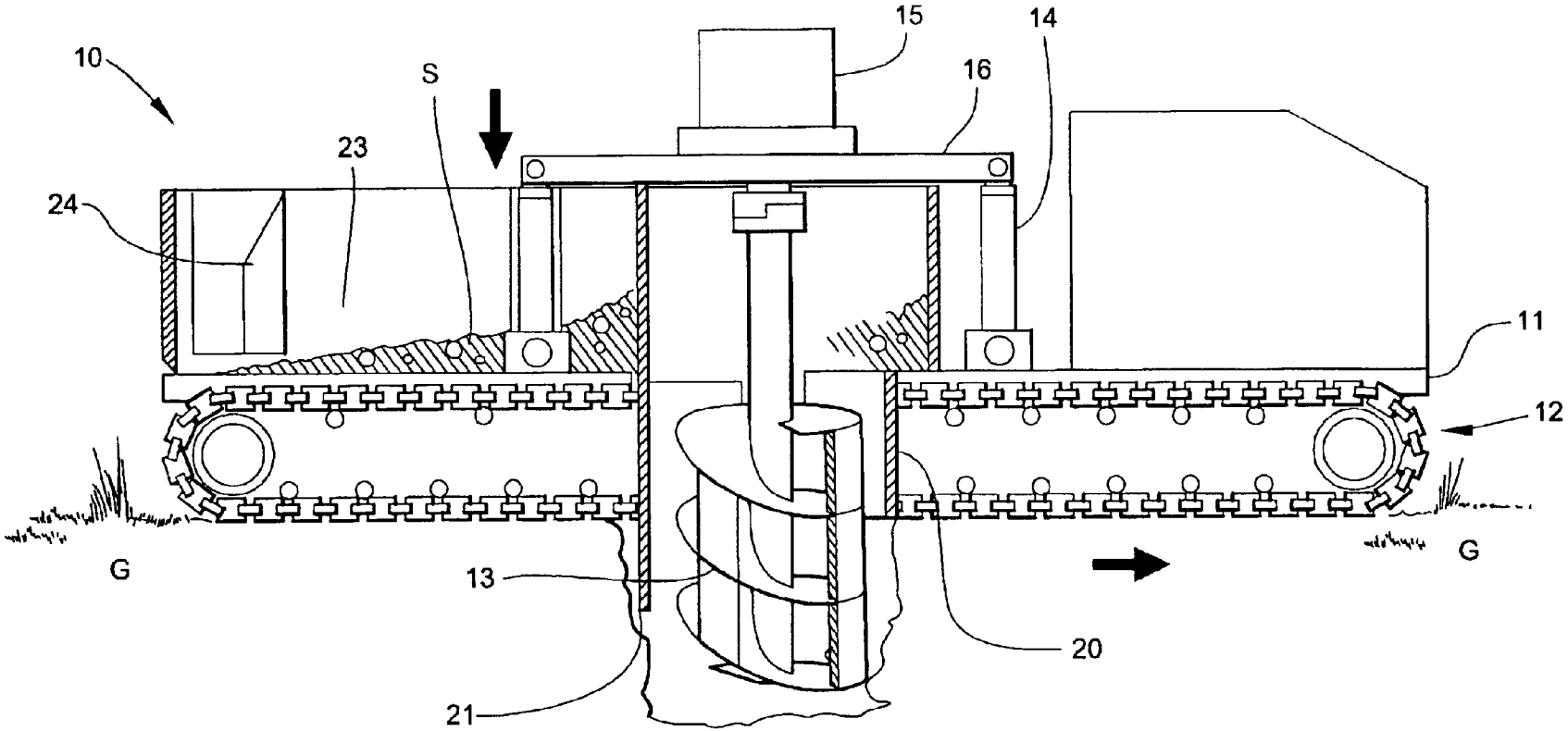
FIG. 3 is a partial cross-section taken generally along the length of a continuous ditch excavator according to a preferred embodiment of the invention after the auger of the excavator has been lowered and rotated to penetrate the ground to a desired ditch depth, the arrow in the top left portion of the drawing indicating the lowered position of the lifts and the arrow in the bottom right portion of the drawing indicating the travel direction of the excavator.
Figure 4:
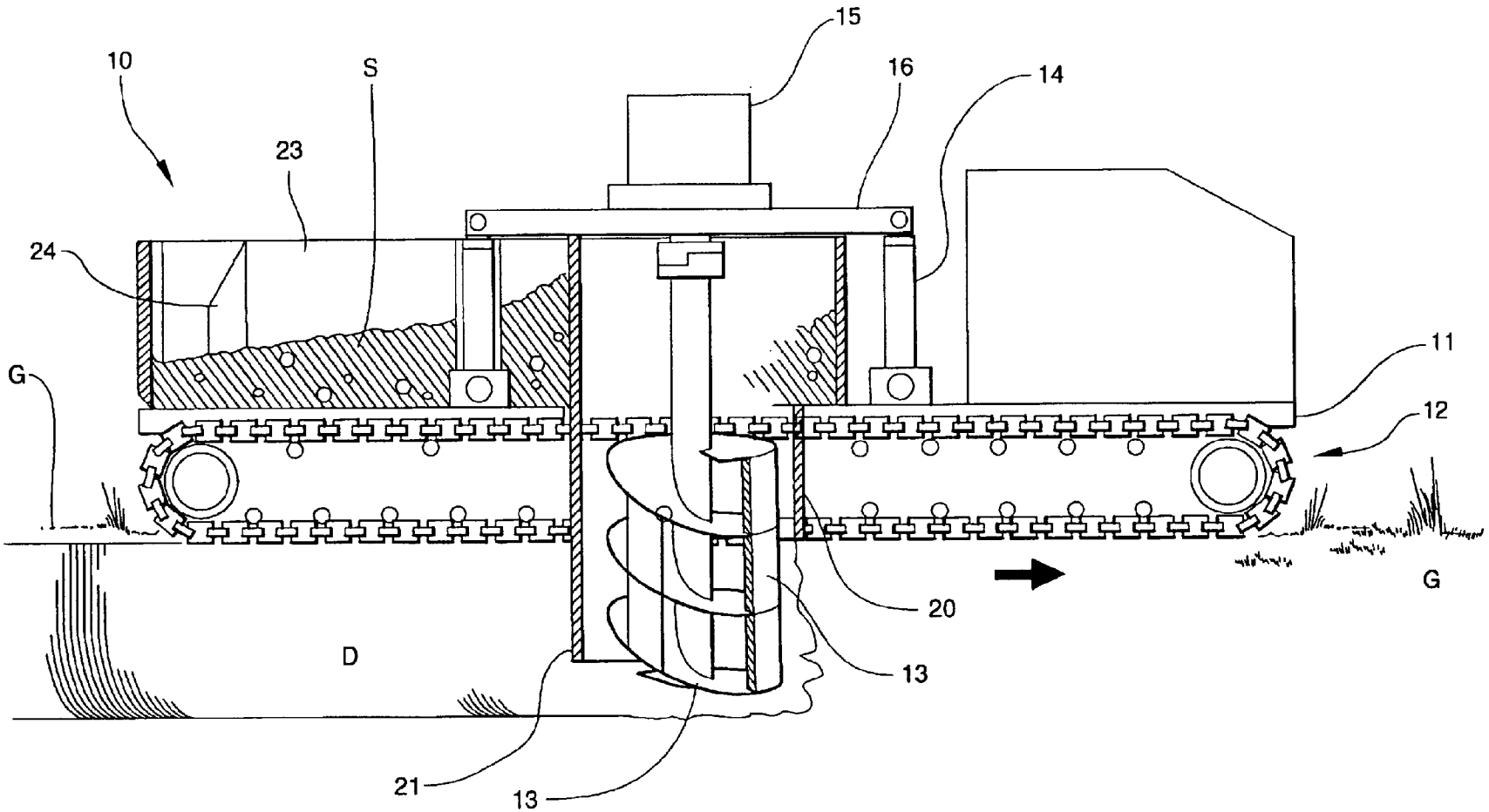
FIG. 4 is a partial cross-section taken generally along the length of a continuous ditch excavator according to a preferred embodiment of the invention after a portion of the desired ditch has been excavated, the arrow in the bottom right portion of the drawing indicating the travel direction of the excavator.

FIGS. 2, 3, and 4 show cross-sectional views of the excavator 10 in three successive stages of operation. FIG. 2 shows the excavator 10 before the auger 13 is lowered to engage the ground "G". As indicated by the arrows in FIG. 2, the auger 13 is raised and lowered as necessary by lift means such as a plurality of hydraulic lifts 14 engaging the auger support 16 and mounted on the chassis 11. Alternatively, the lift means may be gears or pulleys or other non-hydraulic lifting means. The auger 13 is rotated and the lift means 14 are actuated by motor means such as a hydraulic motor 15 mounted on the auger support 16. The motor means driving the auger 13 and lift means 14 could instead comprise a gasoline engine, a diesel engine, or an electric motor.

The excavator 10 includes elements for controlling and containing the soil removed from the ground "G". First, in order to prevent the removed soil from falling back into the ditch as the auger 13 is raised out of the ditch, the excavator 10 includes a containment shield 20, 21 comprising a front containment shield component 20 and a rear containment shield component 21. In a preferred embodiment, the front and rear containment shield components 20, 21 are complementary, spaced-apart, and arcuate plates mounted on the chassis 11 for partially surrounding the auger 13. As the soil-filled auger 13 is lifted out of the ditch by the lifts 14, the containment shield 20, 21 prevents the soil on the auger 13 from falling back into the ditch.

The rear containment shield component 21 extends from an undersurface 22 of the auger support 16 substantially the length of the auger 13 to follow the travel of the auger 13 into and out of the ditch. However, the rear containment shield component is sufficiently short to allow the auger 13 to engage the ground "G" and begin excavation without hindrance. The front containment shield component 20 extends from the chassis 11 to approximately just above the level of the ground "G". In a preferred embodiment, the front containment shield component 20 does not extend above the chassis 11. This configuration of the containment shield 20, 21 provides for maximum control of the soil residing on the rising auger 13.

As the auger 13 is raised out of the ditch past the front containment shield component 20, the soil on the auger falls into a containment bin 23 mounted on the chassis 11. As the containment bin 23 begins to fill up with soil "S", the soil "S" flows out of the containment bin through emptying means such as exit troughs 24. Alternatively, the emptying means may comprise conveyors for removing the soil "S" from the containment bin 23 or hydraulic lifts for dumping out the containment bin 23. The exit troughs 24 of the preferred embodiment empty the soil "S" in the containment bin onto the ground "G" on either side of the ditch. The exit troughs 24 may be provided with doors (not shown) to control the soil flow therethrough.

FIG. 3 shows the excavator 10 after the auger 13 has penetrated the ground "G", with a large arrow showing the direction of forward travel of the excavator 10. FIG. 4 then shows the excavator 10 after the auger 13 has penetrated the ground "G" and partially excavated a ditch "D," again with a large arrow showing the direction of forward travel.

Figure 5:
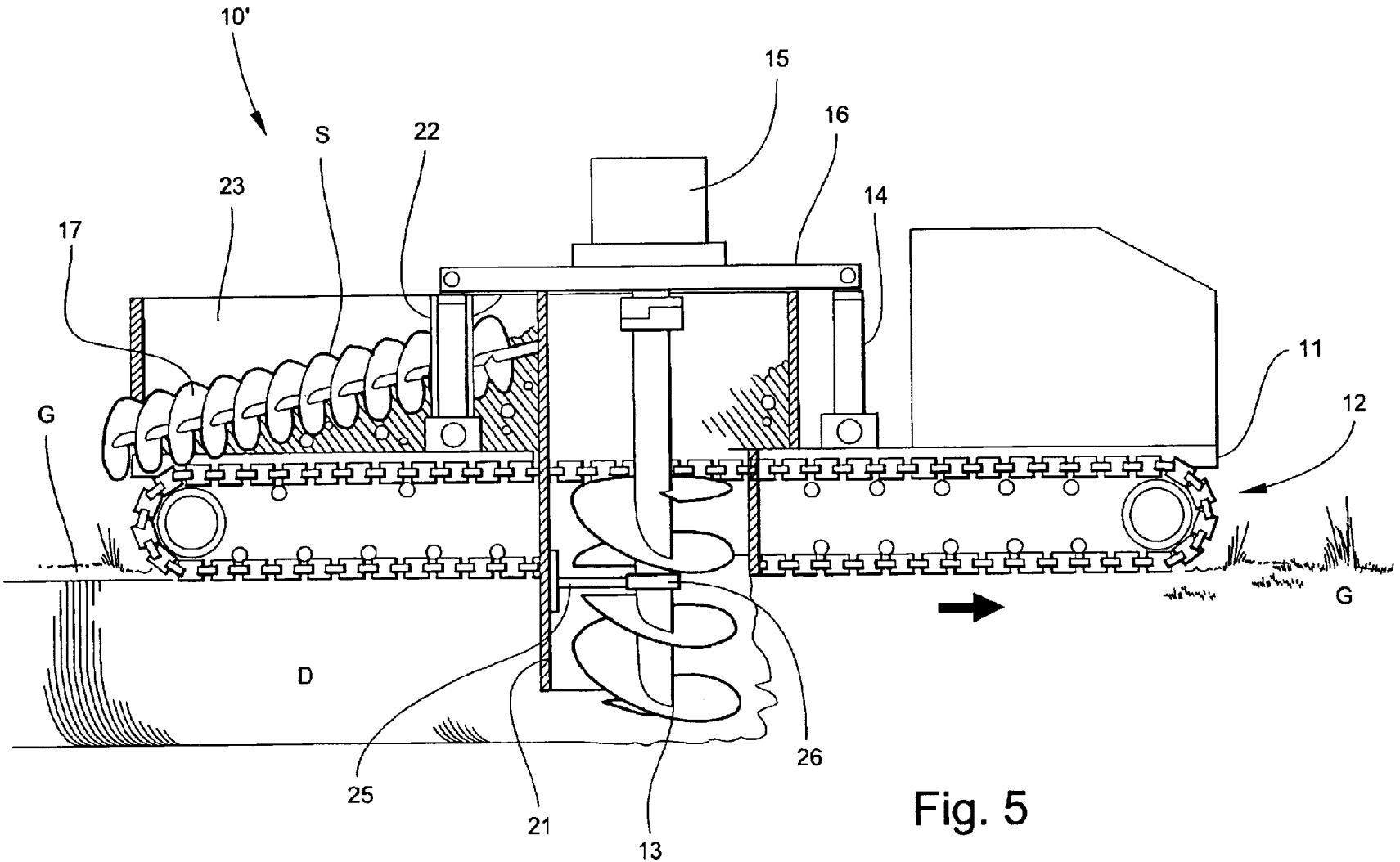
FIG. 5 is a partial cross-section taken generally along the length of a continuous ditch excavator according to another preferred embodiment of the invention in which the excavator includes a stabilizing bar connecting the containment shield and auger, and a second auger for transporting excavated soil out of the excavator.

FIG. 5 shows an alternative embodiment 10' in which a stabilizing bar 25 extends from the rear containment shield component 21 to the auger 13 to stabilize the auger 13 and prevent the auger 13 from contacting the containment shield 20, 21 during operation. An opening of approximately two inches is cut in the blade assembly of the auger 13 to accommodate the stabilizing bar 25. The stabilizing bar 25 is connected to the auger 13 by a collar 26 containing bearings that enable the auger to rotate while maintaining the connection to the stabilizing bar 25.

Figure 5A:
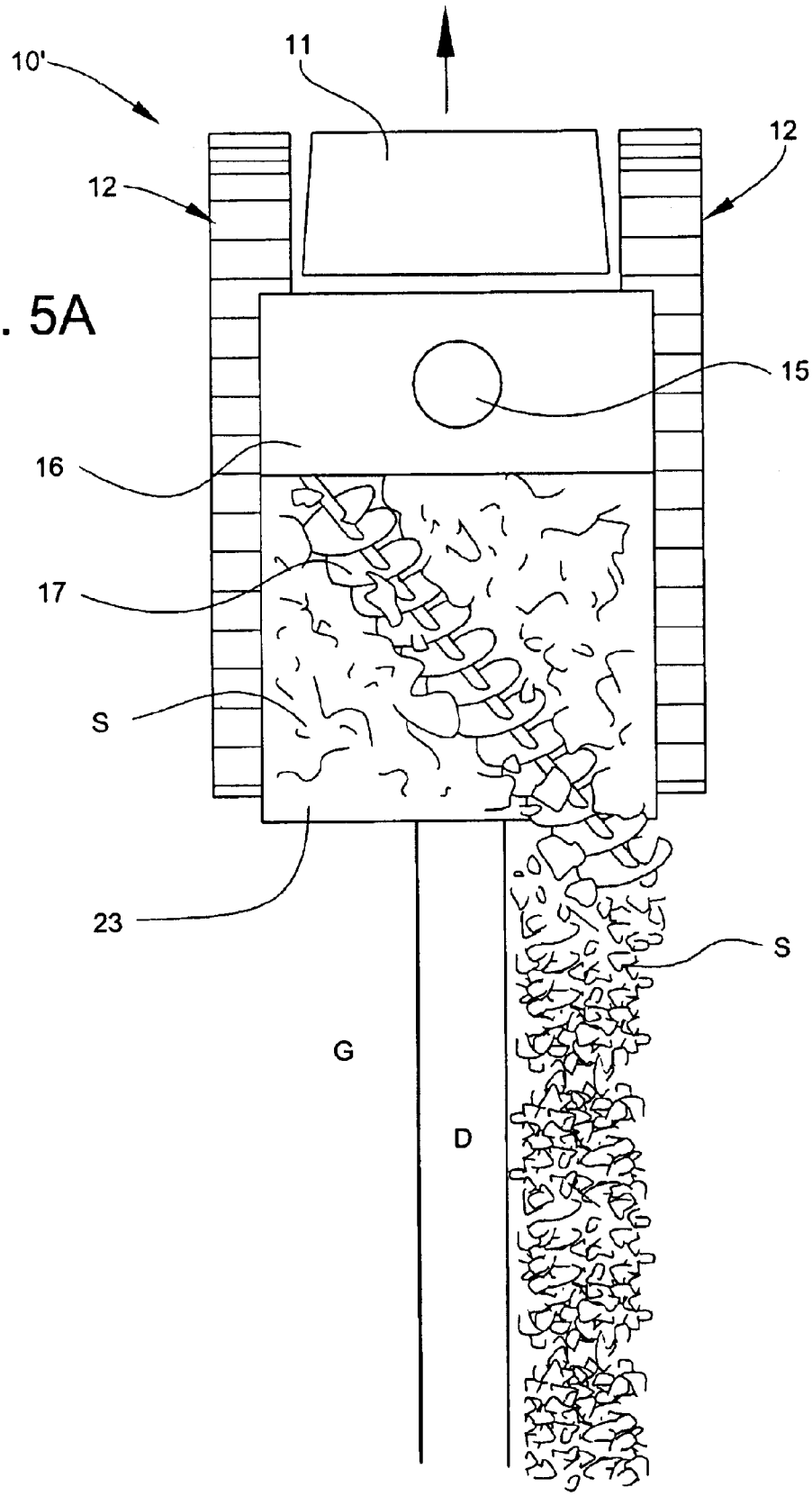
FIG. 5A is a top plan view of the preferred embodiment shown in FIG. 5.

As shown in FIGS. 5 and 5A, the excavator 10' also includes a second auger 17 laterally positioned in the containment bin 23 behind the excavating auger 13. The second auger 17 moves excavated soil "S" out of the containment bin 23 and deposits its along the side of the excavator 10'. As can be seen in FIG. 5A, the second auger 17 extends diagonally across the containment bin 23 from one corner to another.

Figure 6A:
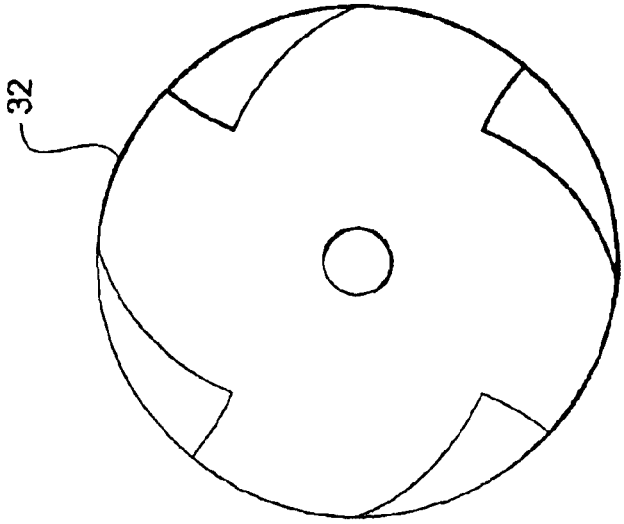
FIG. 6A is a horizontal cross-section taken generally through line 6A—6A of FIG. 6 and showing the blade configuration of the helical auger bit with vertically spaced blades.
Figure 6:
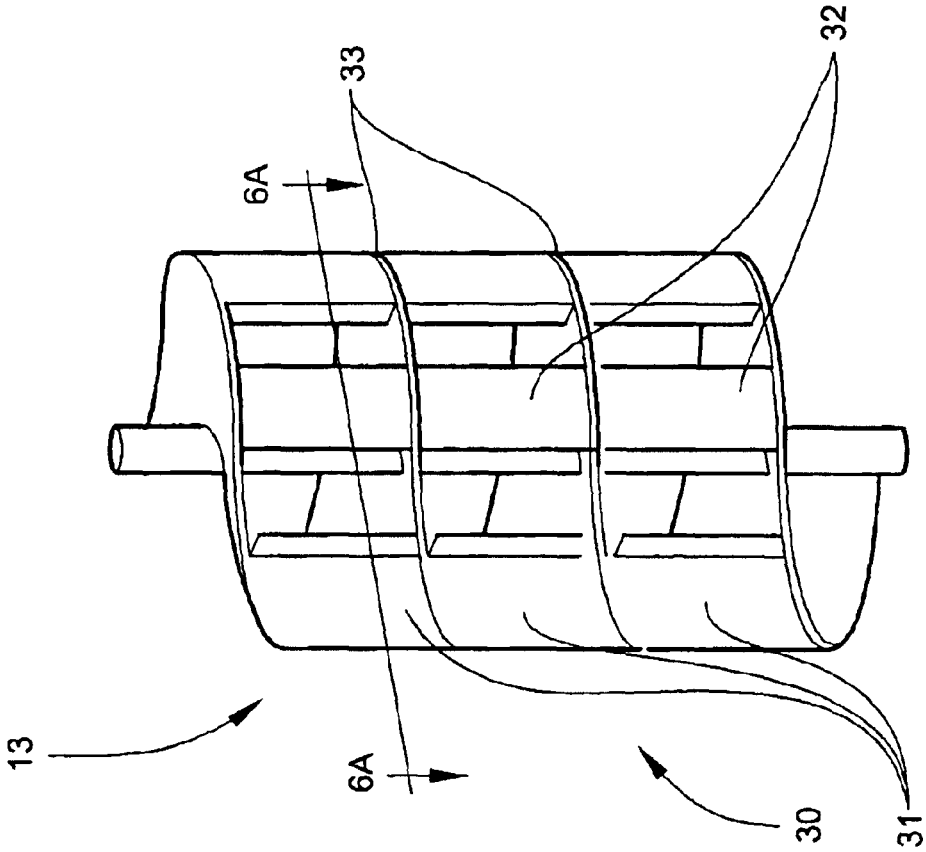
FIG. 6 is a perspective view of a helical auger bit with vertically spaced blades for use on a continuous ditch excavator according to a preferred embodiment of the invention.
Figure 7A:
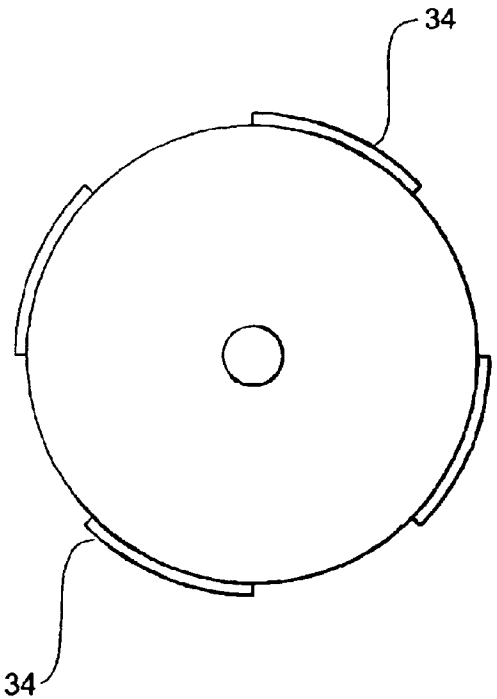
FIG. 7A is a horizontal cross-section taken generally through line 7A—7A of FIG. 7 and showing the blade configuration of the helical auger bit with vertically unitary blades.
Figure 7:
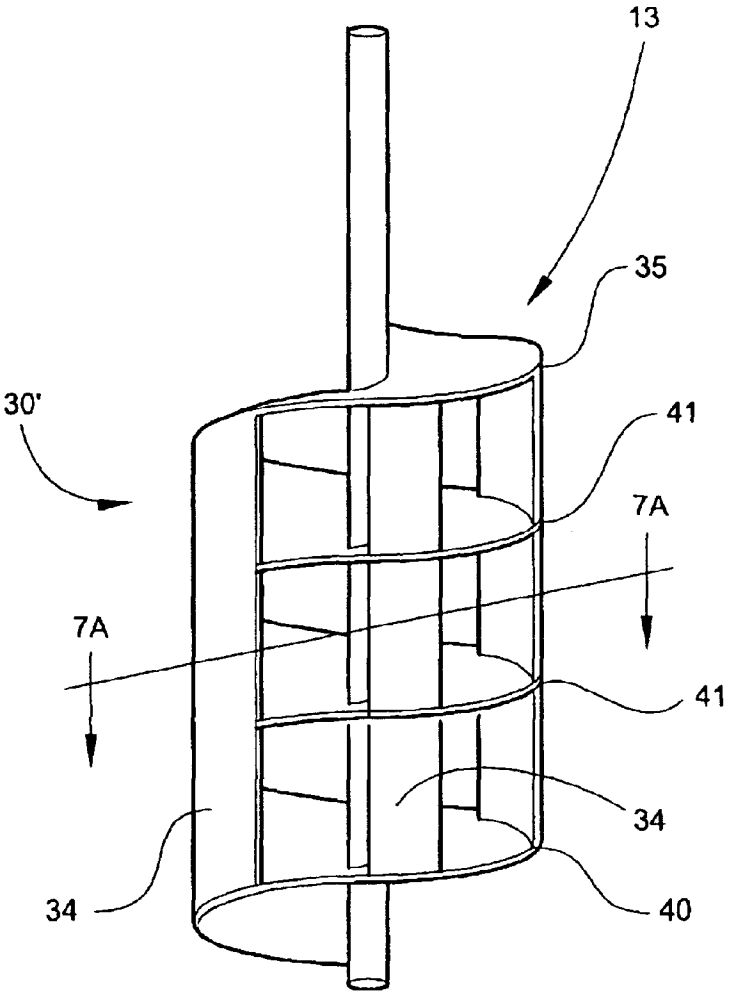
FIG. 7 is a perspective view of a helical auger bit with vertically unitary blades for use on a continuous ditch excavator according to a preferred embodiment of the invention.
Figure 8A:
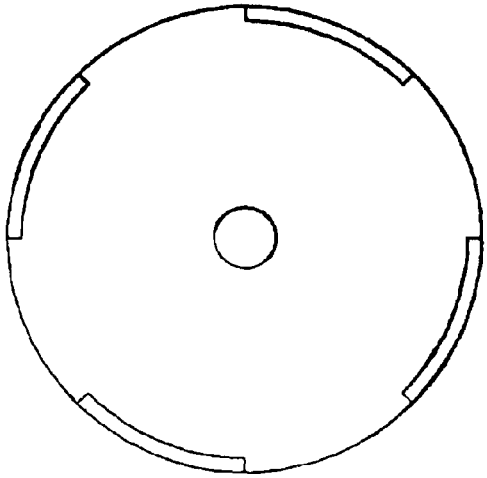
FIG. 8A is a horizontal cross-section taken generally through line 8A—8A of FIG. 8 and showing the blade configuration of the helical auger bit with tapered blades.
Figure 8:
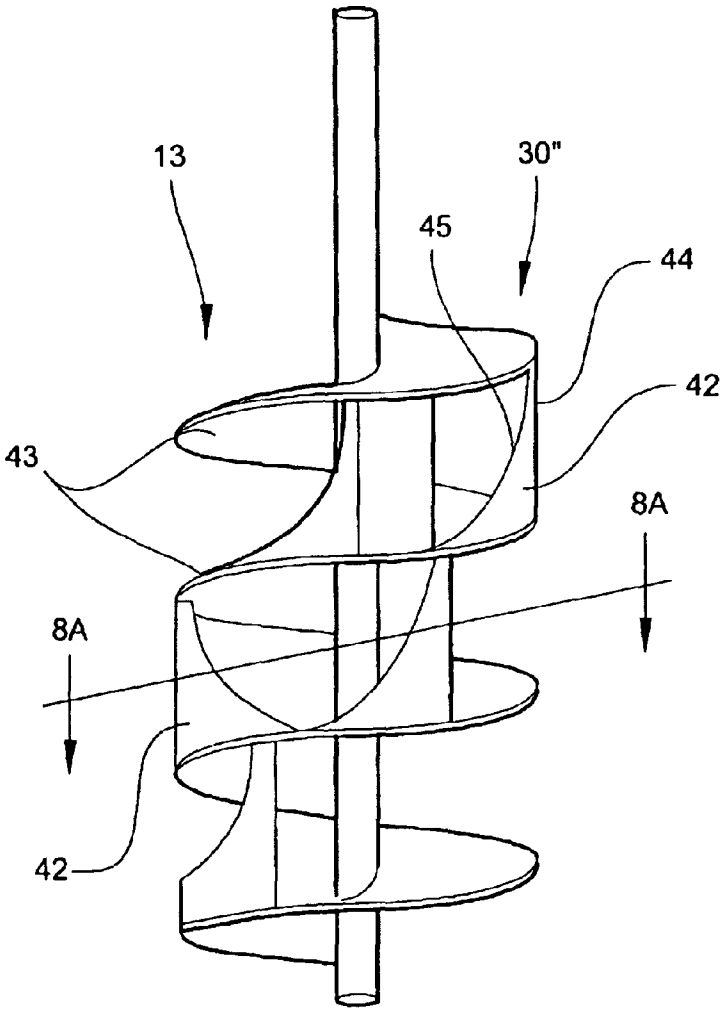
FIG. 8 is a perspective view of a helical auger bit with tapered blades for use on a continuous ditch excavator according to a preferred embodiment of the invention.

FIGS. 6, 6A, 7, 7A, 8, and 8A illustrate three alternative blade assemblies for the auger 13. FIGS. 6 and 6A show an auger blade assembly 30 comprising a plurality of blade plate sets, each blade plate set 31 comprising a plurality of vertically aligned blade plates 32, each pair of adjacent turns 33 in the auger 13 having a blade plate 32 mounted therebetween. FIGS. 7 and 7A show an auger blade assembly 30' comprising a plurality of blades 34, each blade 34 extending from the uppermost turn 35 of the auger 13 to the lowermost turn 40 of the auger 13 and being mounted in a substantially vertical position across the outer edges of the auger turns 41. FIGS. 8 and 8A show an auger blade assembly 30" comprising a plurality of plow-type blades 42, each blade 42 being mounted between adjacent turns 43 in the auger 13. In this preferred embodiment, each blade includes a substantially vertical edge 44 and an edge 45 sloping in the downward direction of the auger turns 43. These three auger blade assemblies are exemplary only; the invention may be used with other blade assemblies depending on the desired ditch dimensions.

Turning now to FIG. 9, the advantage provided by the substantially central disposition of the auger 13 is illustrated in a simplified line drawing. As shown particularly at position "B" in FIG. 8, a ditch "D" having a 90-degree turn may be excavated by the excavator 10 without the need for raising the auger 13 out of the ditch "D" and repositioning the excavator 10. In this way, the auger 13 defines a pivot point about which the excavator 10 may be rotated without removing the auger 13 from the ditch "D". This rotating and pivoting action is best achieved when the auger 13 is substantially centrally disposed within the excavation area 50 defined by the caterpillar tracks 12.

Figure 10:
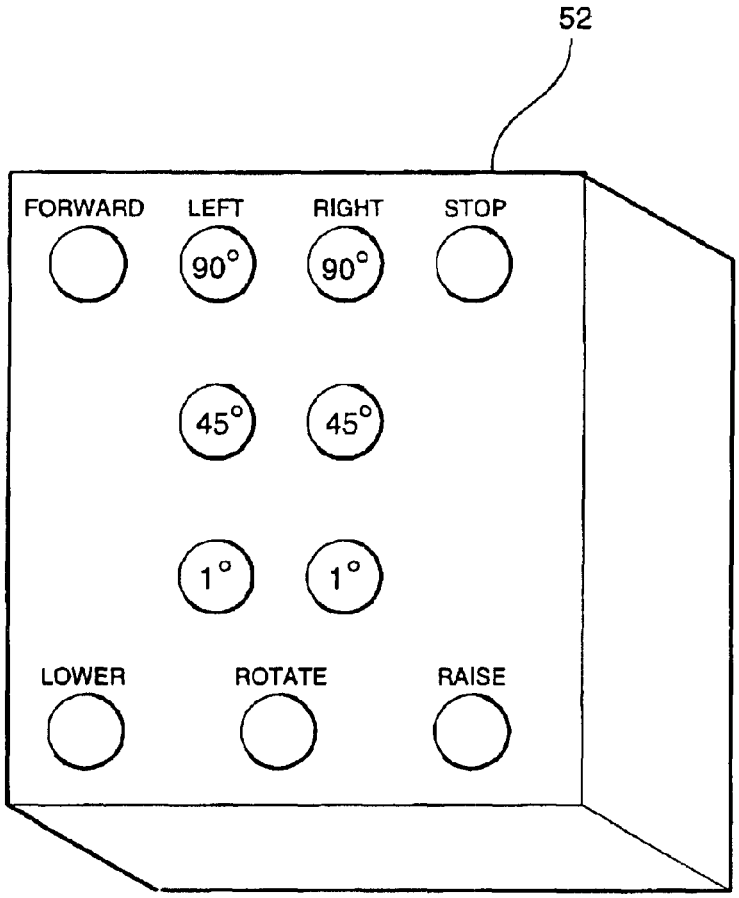
FIG. 10 is a perspective view of a remote control used to remotely operate a continuous ditch excavator according to a preferred embodiment of the invention.
Figure 11:
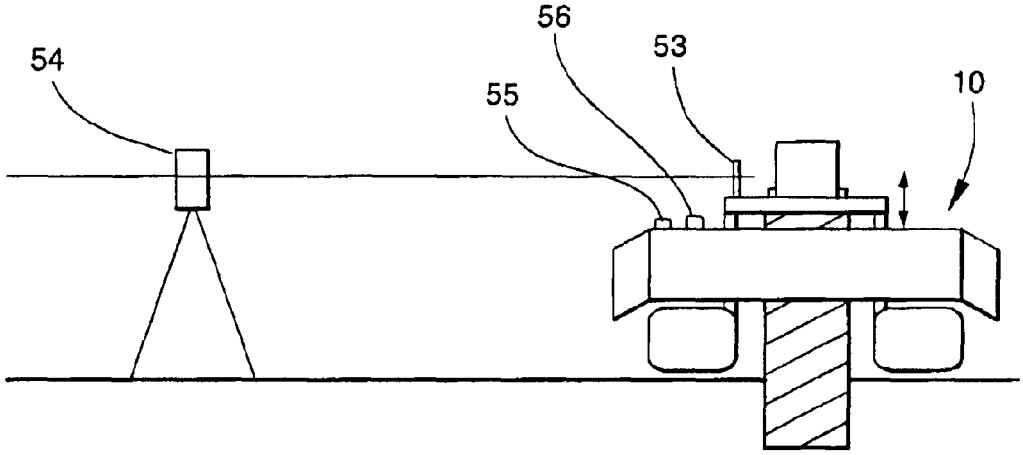
FIG. 11 is a side elevation of a simplified line drawing of a laser guide communicating with and guiding a continuous ditch excavator according to a preferred embodiment of the invention.

FIGS. 1, 10, and 11 illustrate three alternative means of controlling the excavator. Looking first to FIG. 1, an operator cab 51 is shown. The operator cab provides for a human operator "H" to ride aboard the excavator 10. The operator cab includes sufficient speed and direction controls 57 to allow the onboard human operator "H" to manipulate the caterpillar tracks 12 the auger 13, and any other adjustable elements as desired to form a ditch of predetermined dimensions. Alternatively, the excavator 10 may be provided with a sensor and processor (FIG. 11, reference numeral 55) to respond to and execute instructions transmitted by, as shown in FIG. 10, a human-operated remote control unit such as that illustrated at reference numeral 52, thereby allowing remote control of all necessary functions. Thirdly, as shown in simplified line drawing form in FIG. 11, excavator movement may be automated, in part by providing the excavator 10 with an elevation monitor 53 and a distance and direction sensor and processor 56 designed to receive and execute a sequence of computerized instructions (not shown) received from a remote laser level 54, such instructions being programmed in advance to result in the excavation of a ditch of predetermined dimensions.

Figure 12:
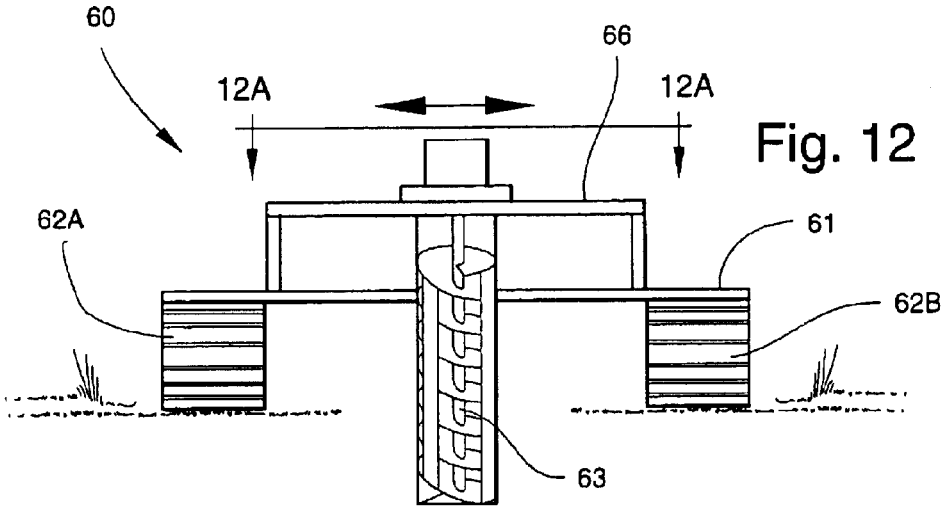
FIG. 12 is a front elevation of a continuous ditch excavator having a laterally moveable auger according to another preferred embodiment of the invention.
Figure 13:
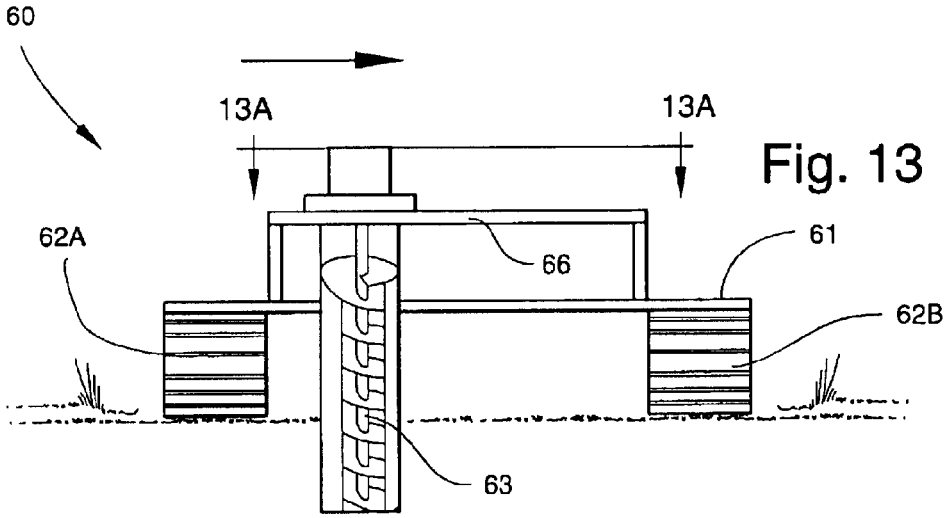
FIG. 13 is another front elevation of the preferred embodiment shown in FIG. 12.
Figure 14:
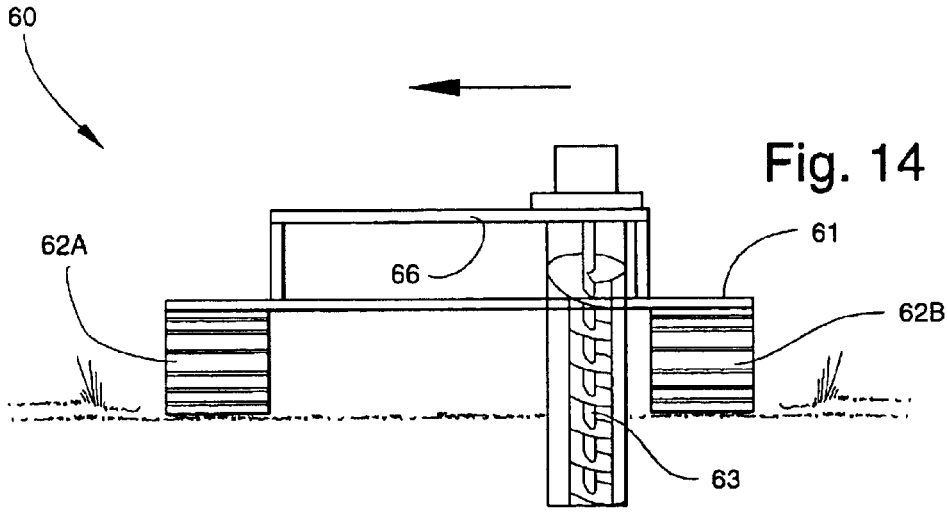
FIG. 14 is yet another front elevation of the preferred embodiment shown in FIG. 12.

A preferred embodiment of the continuous ditch excavator of the invention is illustrated in FIGS. 12–14, and shown generally at reference numeral 60. The preferred excavator 60 has a chassis 61 with caterpillar tracks 62A, 62B, and an excavating auger 63 rotatably mounted to an auger support 66. The auger support 66 includes positioning means that can move the auger 63 laterally as desired from one side of the chassis 61 to the other, as shown in FIGS. 12–14, with arrows depicting movement of the auger 63.

Figure 12A:
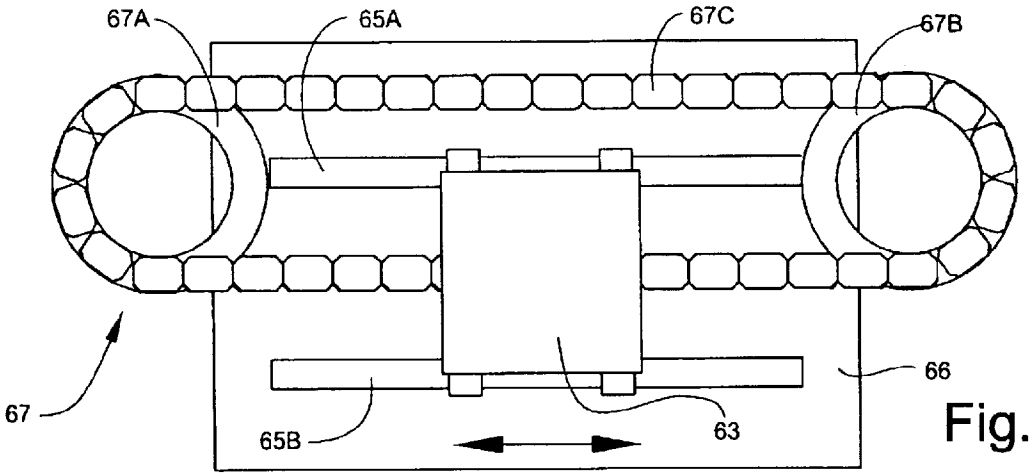
FIG. 12A is a top plan view of the preferred embodiment shown in FIG. 12, along lines 12A—12A.
Figure 13A:
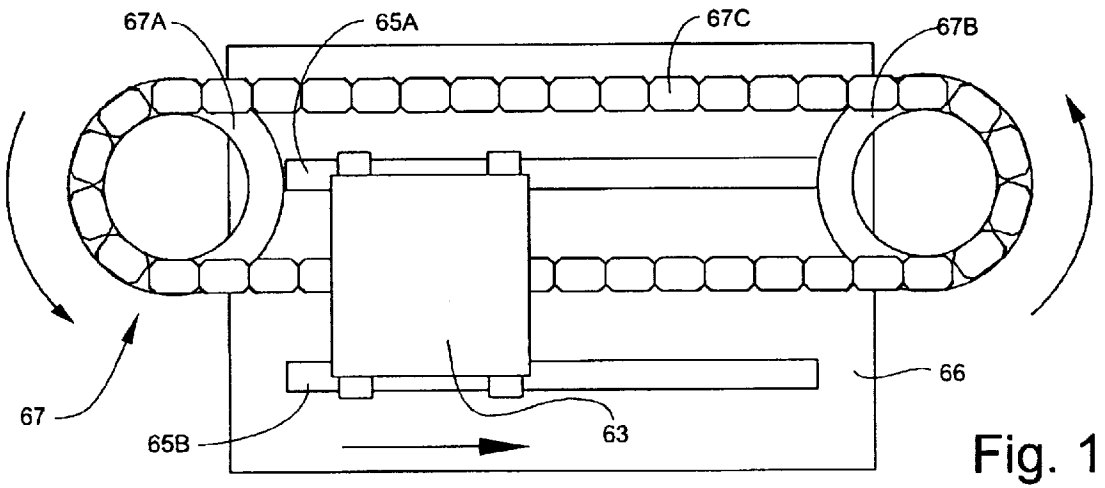
FIG. 13A is a top plan view of the preferred embodiment shown in FIG. 13, along lines 13A—13A.

As shown in FIGS. 12A and 13A, the positioning means preferably comprises two rails 65A, 65B, positioned horizontally on the auger support 66, and a chain assembly 67. The auger 63 is slidably engaged on the rails 65A, 65B. The auger 63 is attached to a chain 67C and is moved laterally from one end of the rails 65A, 65B to the other by movement of the chain 67C. The chain 67C is attached to two wheels 67A, 67B positioned at opposing ends of the rails 65A, 65B. The auger 63 is turned in a desired direction by rotating the wheels in a corresponding direction as shown in 13A, in which the auger is moved toward caterpillar track 62B by rotating the wheels 67A, 67B counterclockwise.

Figure 16:
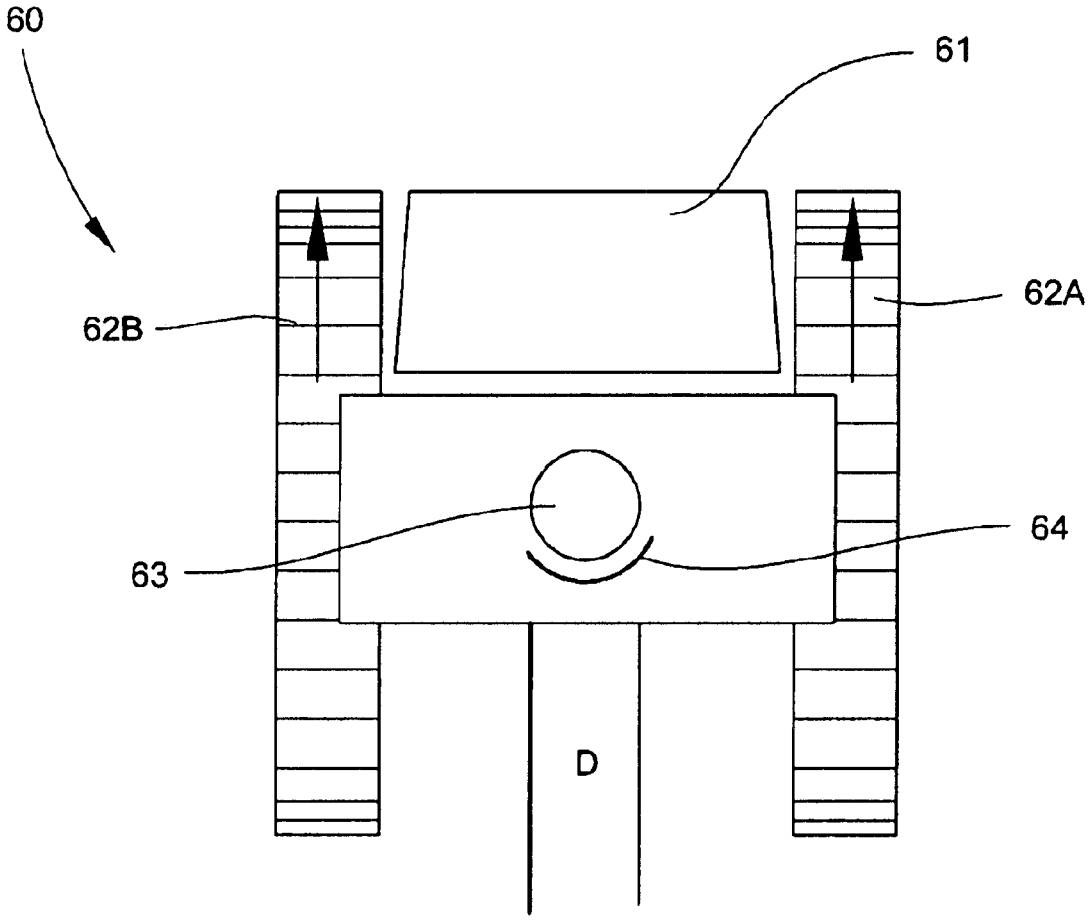
FIG. 16 is another top plan view of the preferred embodiment shown in FIG. 12, with arrows indicating forward movement of the excavator.
Figure 17:
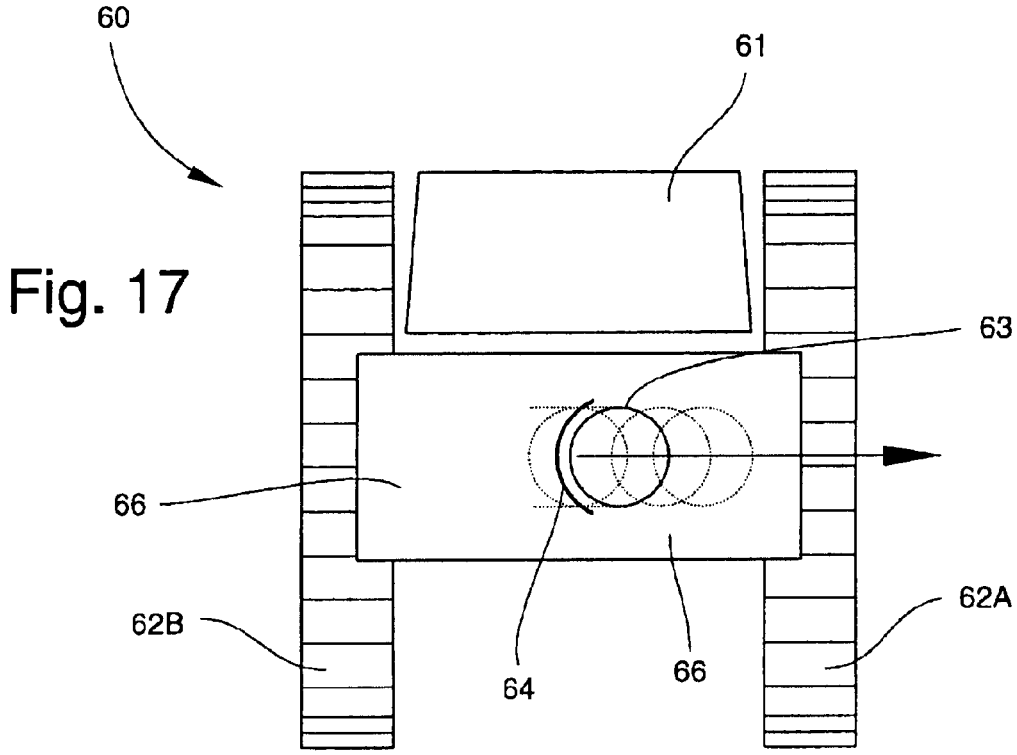
FIG. 17 is yet another top plan view of the preferred embodiment shown in FIG. 12, with an arrow and varying positions of the auger shown in phantom indicating right lateral movement of the auger.
Figure 18:
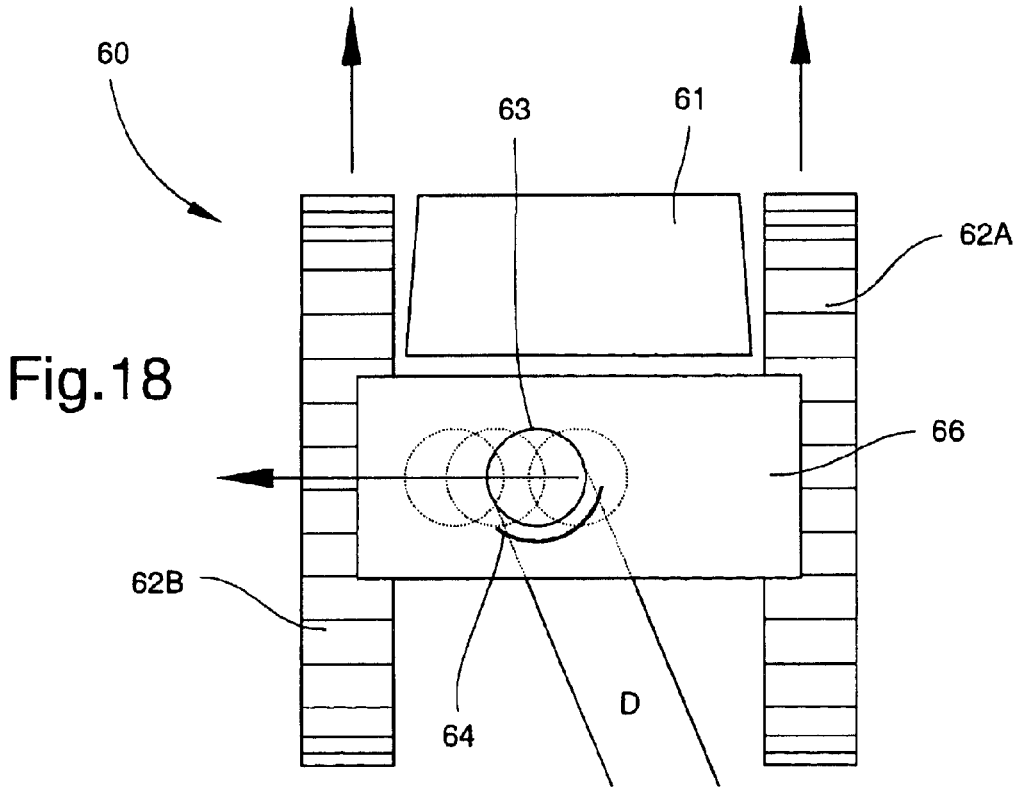
FIG. 18 is yet another top plan view of the preferred embodiment shown in FIG. 12, with two arrows indicating forward movement of the excavator and a third arrow indicating left lateral movement of the auger.

The excavator 60 includes a rearward containment shield 64 that is rotatable so that it can be maintained in a position opposite to the direction of travel of the auger 63, as shown in FIGS. 16–18. FIG. 16 shows the chassis 61 moving forward with the auger 63 maintained in a set position at the center of the chassis 61, and the shield 64 is in a 6 o'clock position. In FIG. 17, the chassis 61 is stationary and the auger 63 is moving laterally toward the right side of the chassis 61, so the shield is in a nine o'clock position. In FIG. 18, the chassis 61 is moving forward while the auger moves laterally toward the left side of the chassis, resulting in a diagonal direction of movement for the auger. As such, the shield 64 is placed in approximately a four o'clock position.

Figure 15:
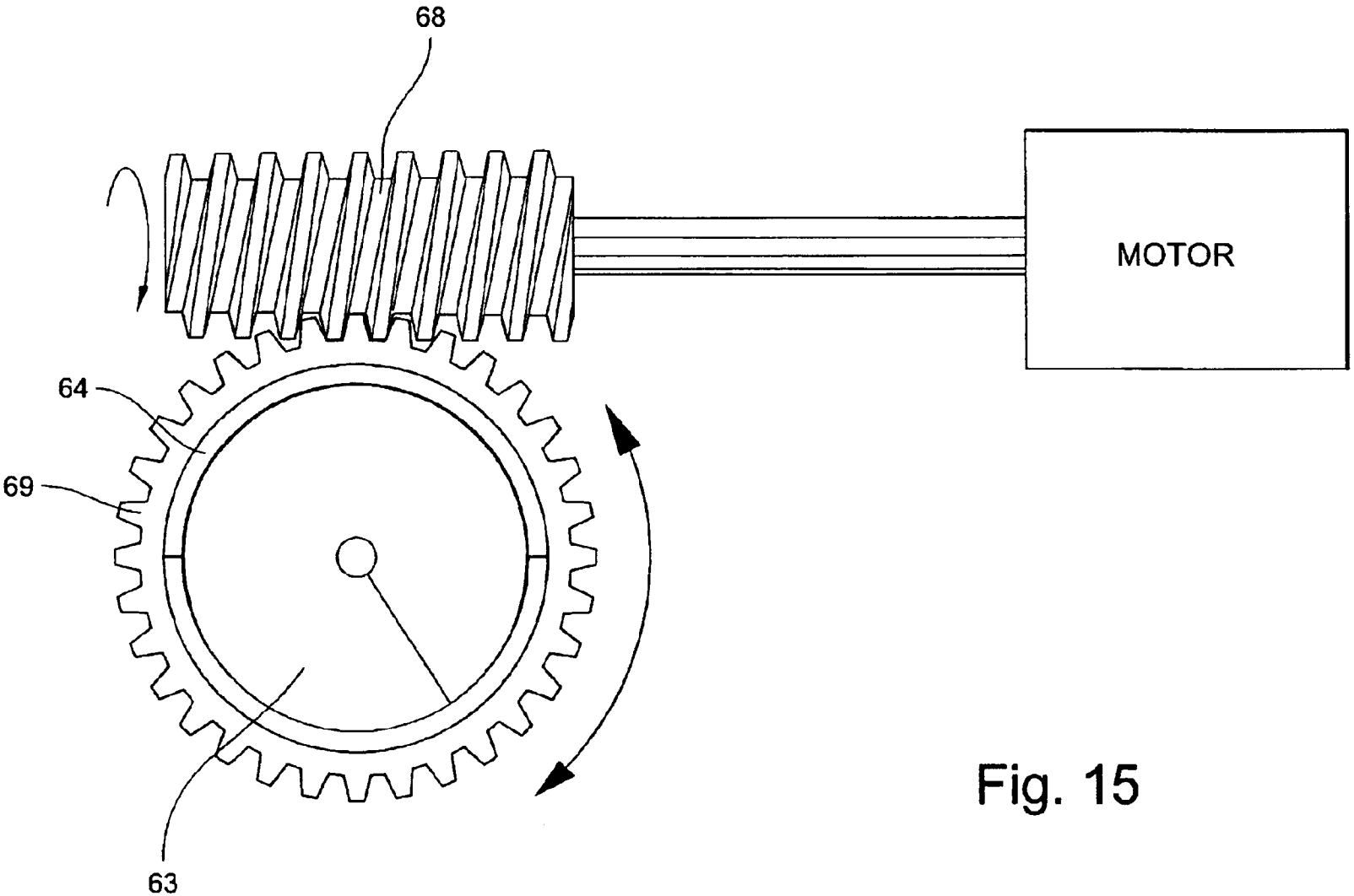
FIG. 15 is a top plan view of an auger and means for rotating the auger according to a preferred embodiment of the invention.

As shown in FIG. 15, the containment shield 64 can be rotated by communication between a worm gear shaft 68 and a gear plate 69 that is attached to the shield 64. A motor turns the shaft 68.

Figures 19, 19A, 19B, 19C, 19D:
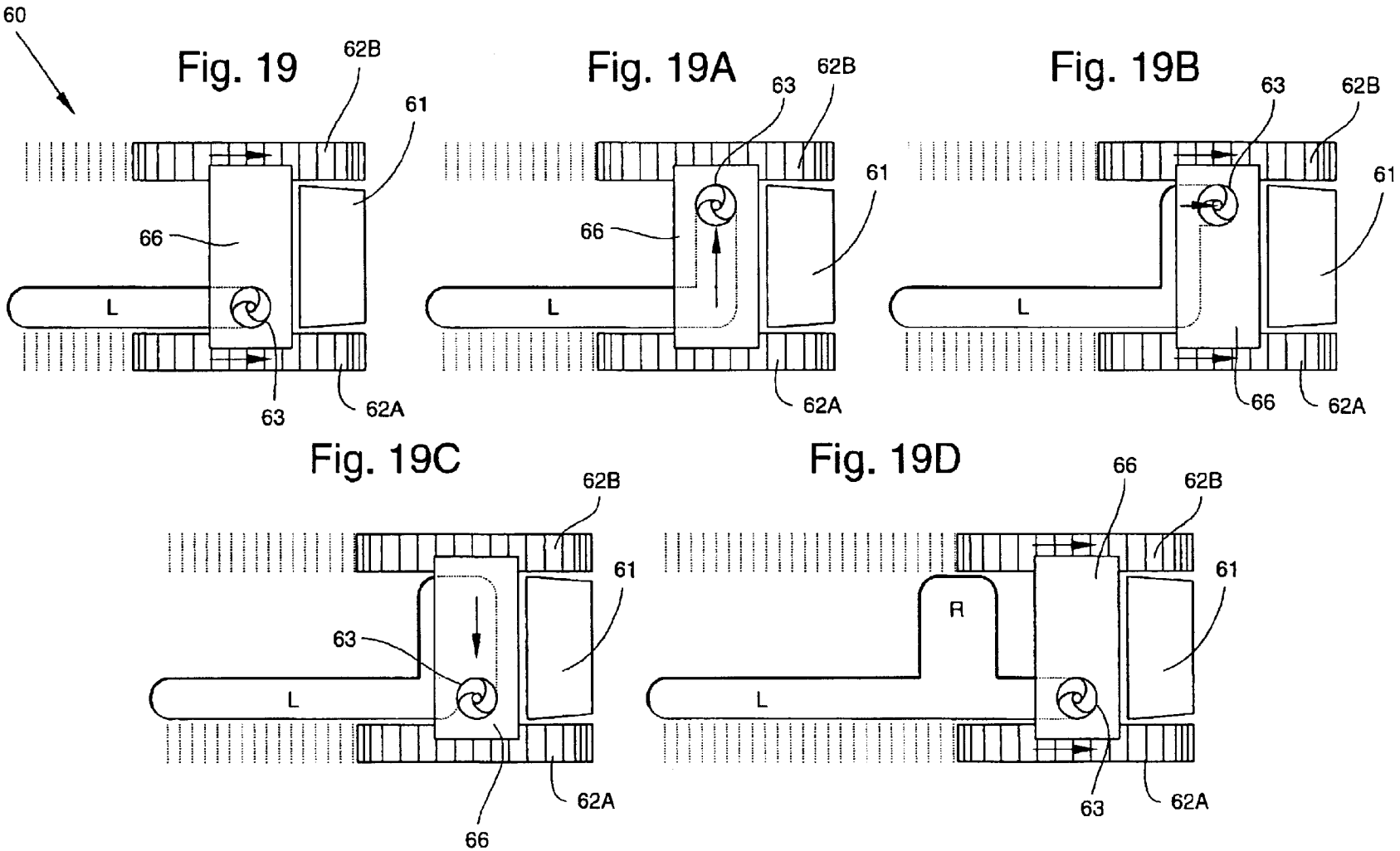
FIGS. 19 through 19D are top plan views illustrating a preferred method for using the preferred embodiment shown in FIG. 12.

Lateral movement of the auger 63, coupled with movement of the chassis 61 by the caterpillar tracks 62A, 62B, greatly enhances the versatility and utility of the excavator 60. For instance, the excavator 60 is particularly useful in digging a particular kind of formation commonly known in the construction industry as a "spread footing" or "column footing." A spread-footing, shown in FIG. 19D, is a continuous linear ditch with a substantially rectangular segment "R" extending from the continuous line "L" of the ditch. Often a plurality of rectangular segments are made at particular spaced-apart intervals along the line. Excavation of such ditches is common as column supports for buildings are positioned in the rectangular segments "R" of the ditch.

A preferred method for excavating a spread-footing using excavator 60 is illustrated in FIGS. 19–19D. As shown in FIG. 19, the excavator 60 creates a first linear ditch "L" by moving forward in a straight line with the auger 63 lowered in the ground and positioned on the far right side of the chassis 61. At a predetermined point, the excavator 60 stops and the auger 63 is moved laterally to the left side of the chassis 61 creating a second linear ditch, shown in phantom in FIG. 19A, that is perpendicular to the first linear ditch "L." The excavator 60 then moves slightly forward and stops again, as shown in FIG. 19B. The auger is moved laterally back to the right side of the chassis, as shown in FIG. 19C, and creates a third linear ditch adjacent and parallel to the second linear ditch to form a rectangular ditch "R" extending from the first linear ditch "L." Finally, the excavator 60 proceeds forward to continue digging the first linear ditch "L", as shown in FIG. 19D. This process can be repeated for any number of times to form the desired number of rectangular segments "R."

Figure 20:
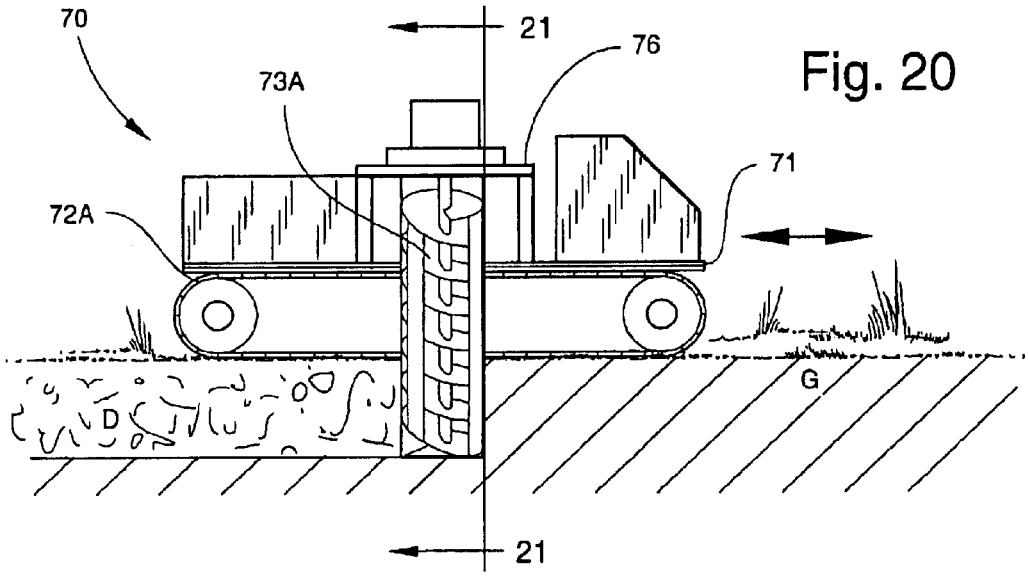
FIG. 20 is a side elevation of a continuous ditch excavator having a plurality of augers according to yet another preferred embodiment of the invention.
Figure 21:
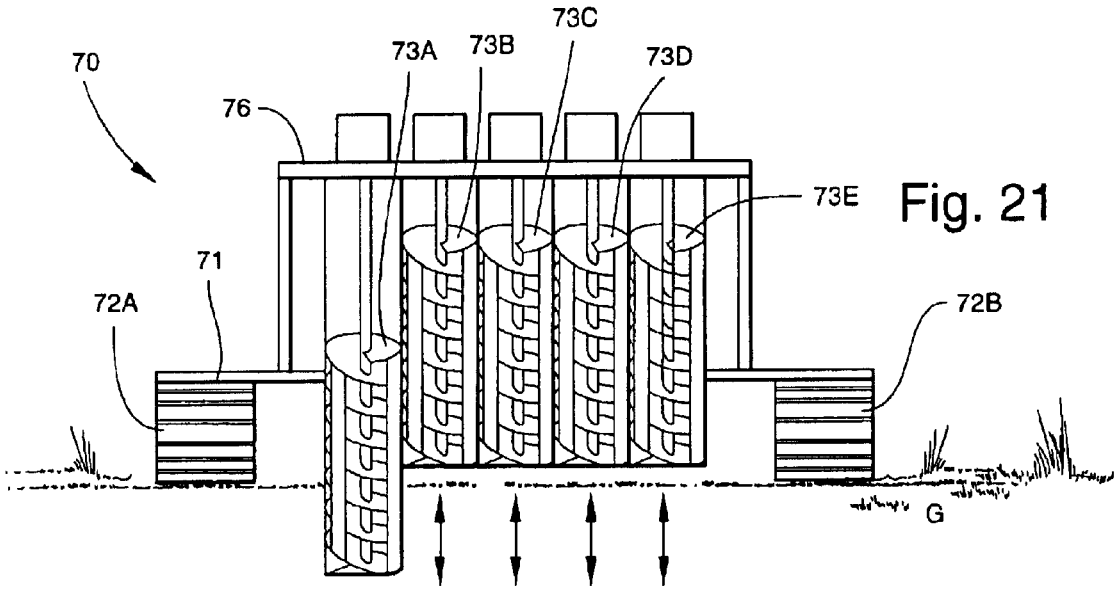
FIG. 21 is a front cross sectional view of the preferred embodiment shown in FIG. 20, along lines 21—21.

Another preferred embodiment of the invention is illustrated in FIGS. 20–21, and shown generally at reference numeral 70. The excavator 70 generally comprises a chassis 71 with caterpillar tracks 72A, 72B, and a plurality of excavating augers 73A, 73B, 73C, 73D, 73E rotatably mounted to an auger support 76. The augers 73A, 73B, 73C, 73D, 73E are positioned linearly from one side of the chassis 71 to the other. The center auger 73C defines a pivot point about which the caterpillar tracks 72A, 72B are adapted to rotate the chassis 71 to control the direction of ditch excavation. The augers 73A, 73B, 73C, 73D, 73E are independently connected to lift means such as a plurality of hydraulic lifts (not shown) engaging the auger support 76 so that each auger can be independently raised and lowered into the ground.

Figures 22, 22A, 22B, 22C:
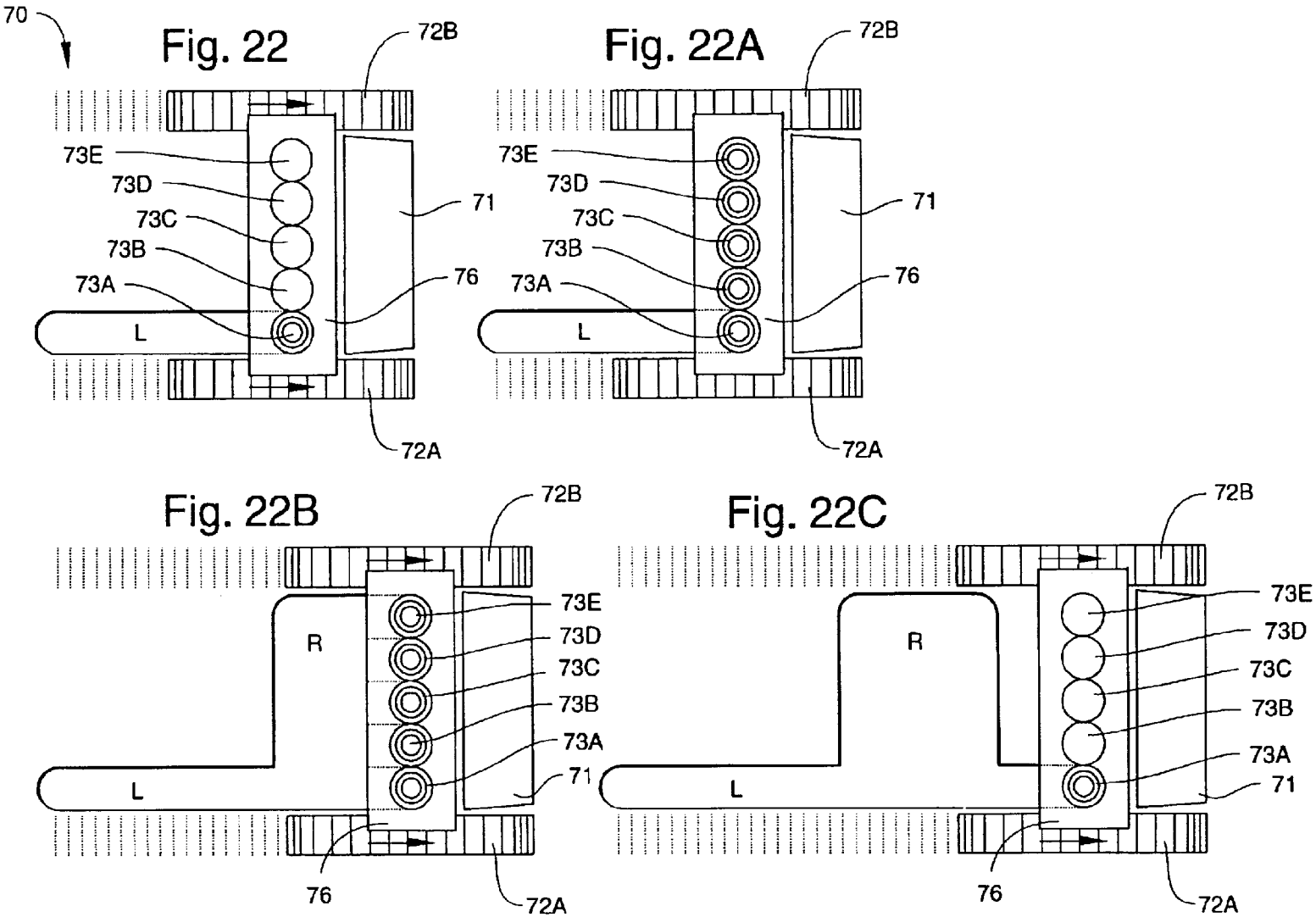
FIGS. 22 through 22C are top plan views illustrating a preferred method for using the preferred embodiment shown in FIG. 21.

A preferred method of excavating a spread-footing formation using excavator 70 is illustrated in FIGS. 22–22D. As shown in FIG. 22, the excavator moves forward with only the auger 73A located on the far right side of the chassis 71 lowered into the ground to form a linear ditch "L." Next, the excavator 70 stops at a predetermined point, and lowers all of the remaining augers 73B, 73C, 73D, 73E into the ground, as shown in FIG. 22A. The excavator 70 then proceeds forward a predetermined distance with all augers 73A, 73B, 73C, 73D, 73E lowered into the ground, as shown in FIG. 22B, to form a rectangular segment "R." Finally, the excavator stops at a predetermined point, raises augers 73B, 73C, 73D, 73E, and proceeds forward with auger 73A remaining in the ground, as shown in FIG. 22C. This process can be repeated any number of times to produce a desired number of rectangular segments "R" extending from the linear ditch "L."

In addition, the excavator 70 can excavate up to three linear ditches simultaneously. To excavate three ditches simultaneously, three non-adjacent augers 73A, 73C, 73E are lowered into the ground G and the excavator 70 proceeds forward a desired distance.

Figure 23:
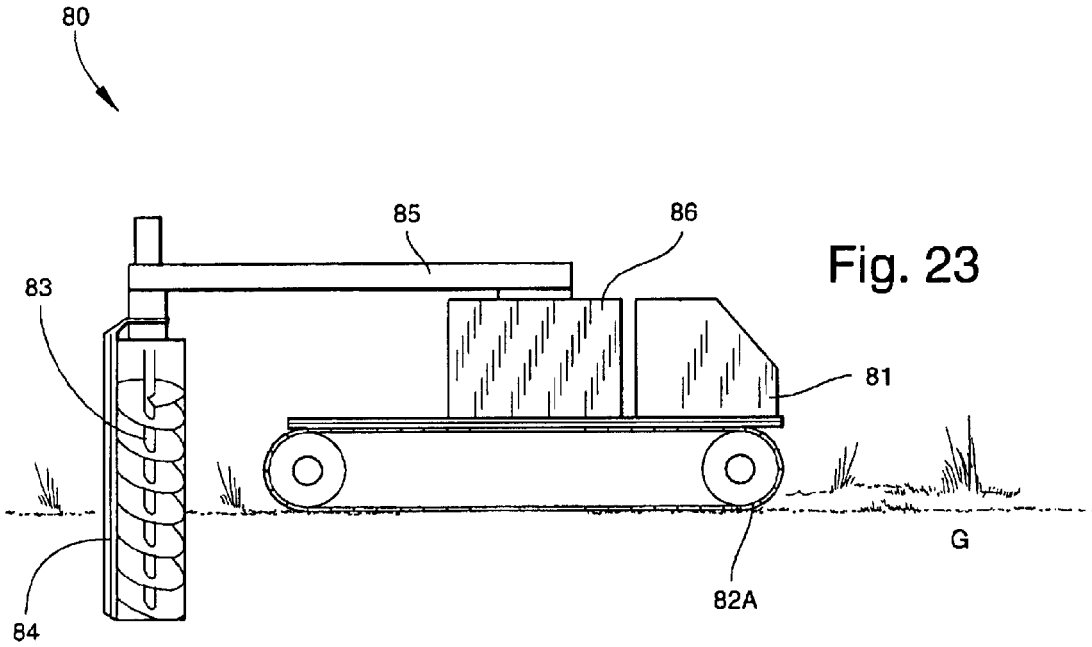
FIG. 23 is side elevation of continuous ditch excavator having a rotatable arm according to yet another preferred embodiment of the invention.
Figure 24:
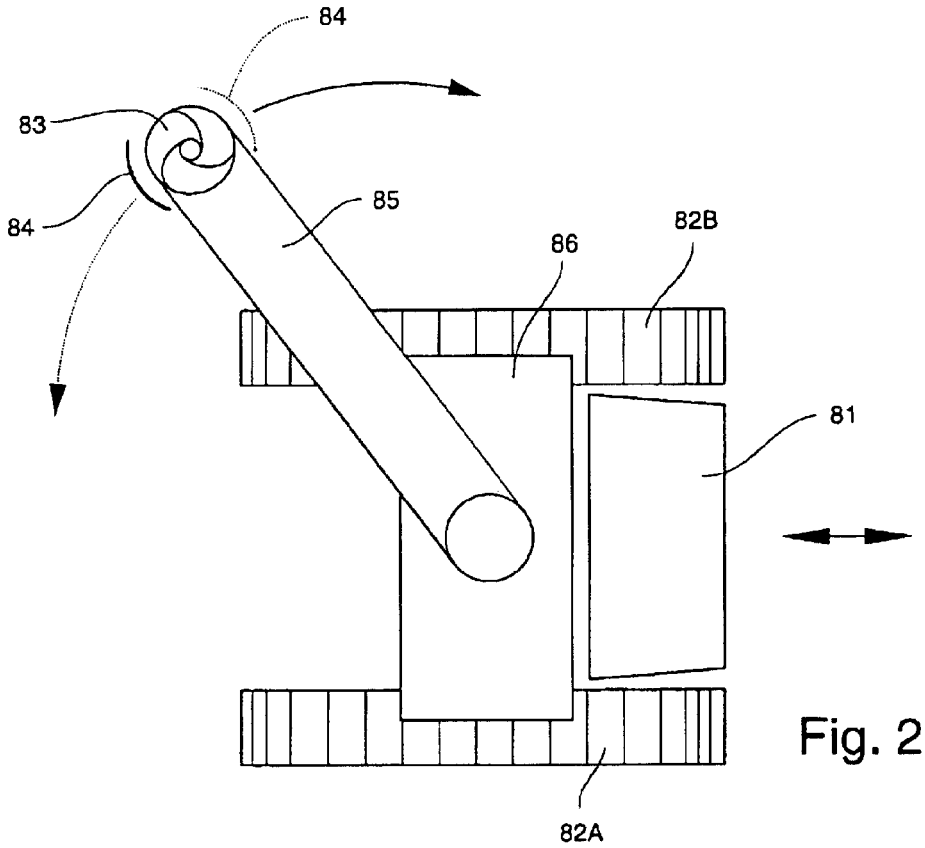
FIG. 24 is a top plan view of the preferred embodiment shown in FIG. 23.

Yet another preferred embodiment of the invention is illustrated in FIGS. 23 and 24, and shown generally at reference numeral 80. The excavator 80 includes a chassis 81, caterpillar tracks 82A, 82B, and an auger 83 mounted vertically on a horizontal arm 85. The arm 85 is rotatably mounted proximate the center of the top of an arm support 86 positioned on the chassis 81, and extends horizontally to point beyond the chassis 81 so that the arm can rotate 360° around the excavator 80. The arm 85 is connected to lift means such as a hydraulic lift (not shown) engaging the arm support 86 so that the arm can be raised and lowered. The auger 83 is raised and lowered into the ground by the vertical movement of the arm 85. The auger 83 is rotatably connected to motive means on the arm 85 so that the auger 83 can move along the length of the arm 85.

The excavator 80 includes a rearward rotatable containment shield 84. The shield 84 is preferably maintained in a position opposite to the direction of travel of the auger 83, as shown in FIGS. 23 and 24.

A preferred method for excavating a spread-footing formation using the excavator 80 is illustrated in FIGS. 25–25D. The arm 85 is rotated so that it extends perpendicularly and to the left of the chassis 81, as shown in FIG. 25. The auger 83 is positioned approximately at the center of the arm, proximate the outer edge of the left side caterpillar track 82B. As shown in FIG. 25, the excavator 80 moves forward with the auger 83 lowered into the ground to begin formation of a first linear ditch "L." The excavator 80 stops at a predetermined point, and the auger 83 is moved outwardly to the far end of the arm 85, as shown in FIG. 25A, to form a second linear ditch perpendicular to the first linear ditch "L." The excavator 80 then moves slightly forward, as shown in FIG. 25B. Next, the auger 83 moves back to its original position on the arm 85, as shown in FIG. 25C, making a third linear ditch adjacent and parallel to the second linear ditch to form a rectangular segment "R" extending from the first linear ditch "L." The excavator 80 then proceeds forward again as shown in FIG. 25D. The above steps can be repeated any number of times to form the desired number of rectangular segments "R."

Figure 26:
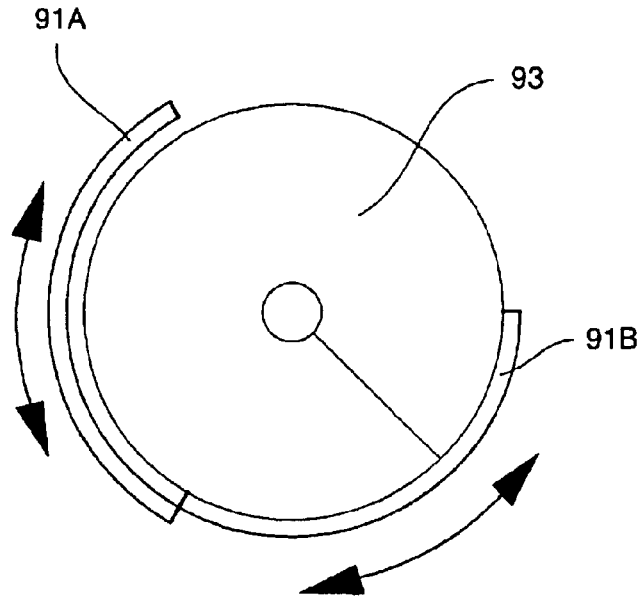
FIGS. 26 through 26B are top plan views of preferred containment shields in varying positions about an auger.
Figure 26A:
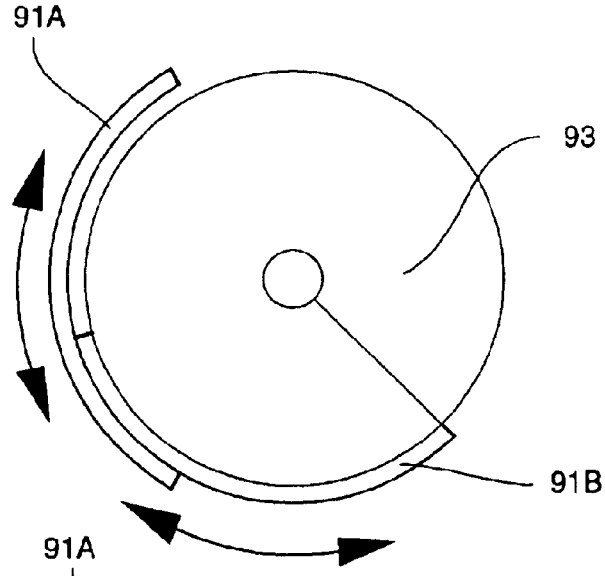
Figure 26B:
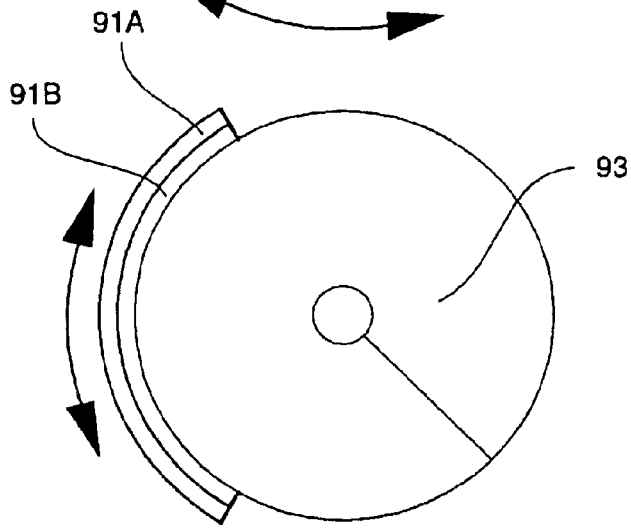

In yet another preferred embodiment, the invention includes two rearward containment shields 91A, 91B positioned in different planes about the auger 93. Each of the shields 91A, 91B cover approximately one-third of the circumference of the auger 93, and is independently rotatable about the auger 93 so that the amount of exposed auger is variable from as much as two-thirds to as little as one-third, as demonstrated in FIGS. 26–26B. For example, the shields 91A, 91B can be positioned such that they are contiguous but do not overlap so that they surround approximately two-thirds of the circumference of the auger 93, as in FIG. 26. The shields 91A, 91B can be positioned such that they partially overlap so that they surround approximately one-half the auger 93, as in FIG. 26A. Or the shield can be positioned such that they completely overlap each other and surround only one-third of the auger as shown in FIG. 26B.

Figure 27:
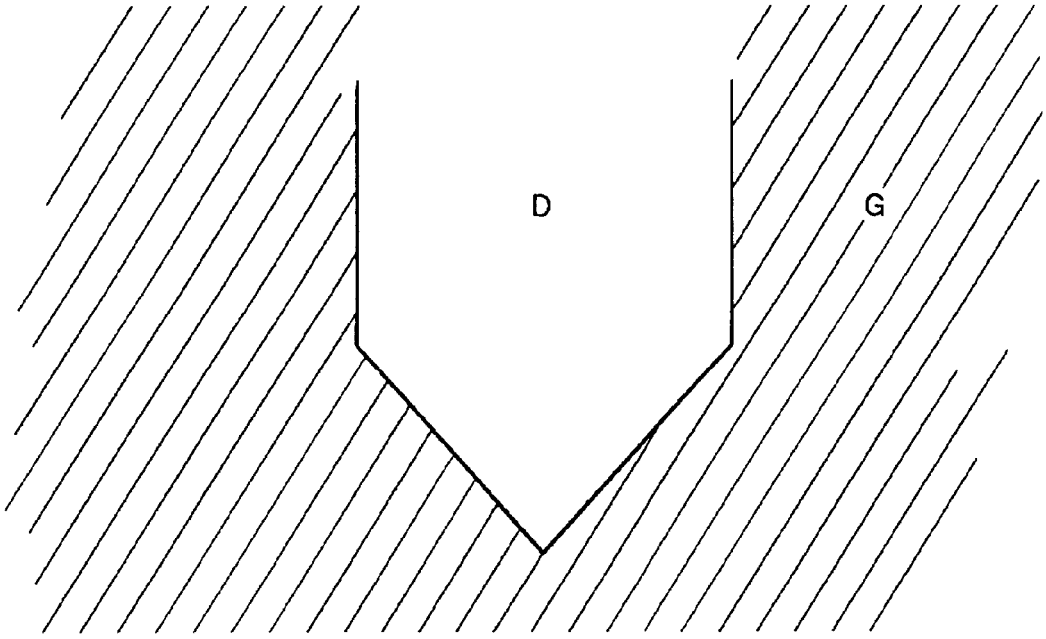
FIG. 27 is a cross-sectional view of a ditch formation made by a preferred auger according to the invention.
Figure 28:
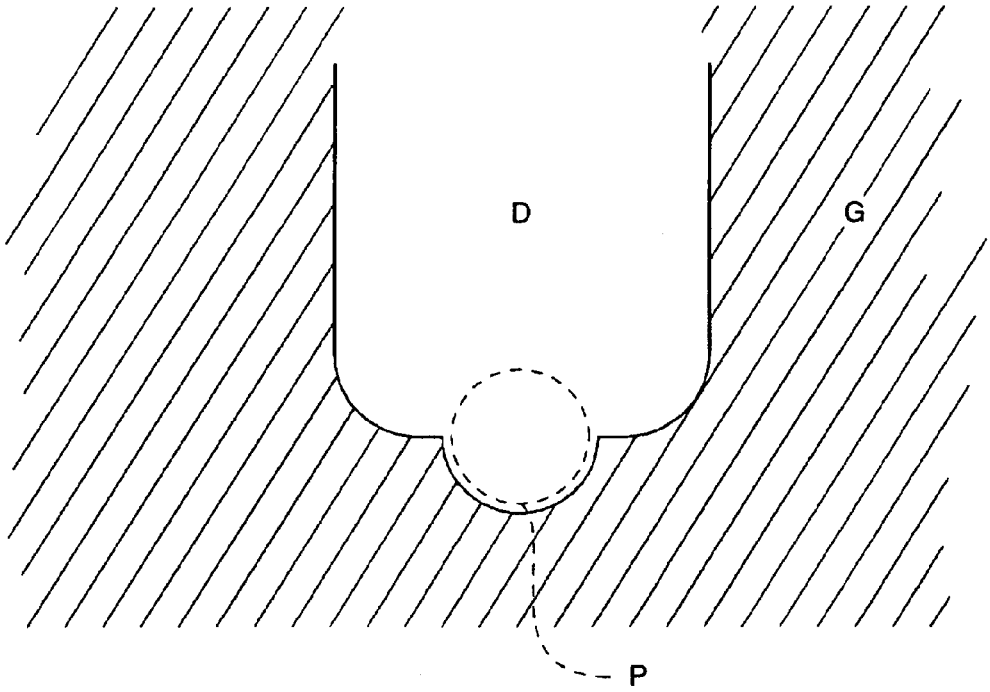
FIG. 28 is a cross-sectional view of a ditch formation made by another preferred auger according to the invention.

In yet another preferred embodiment of the invention, the auger is adapted to excavate ditches with base surfaces having a particular shape other than simply a straight line. For instance, FIG. 27 shows a ditch "D" with a V shaped base that is particularly useful in drainage ditches. FIG. 28 shows a ditch "D" with a base having a half-circle cut through the center that is conducive for running a pipe-line "P."

A continuous ditch excavator is described above. Various details of the invention may be changed without departing from its scope. Furthermore, the foregoing description of the preferred embodiments of the invention and the best mode for practicing the invention are provided for the purpose of illustration only and not for the purpose of limitation—the invention being defined by the claims.

I claim:

1. A continuous ditch excavator, comprising:

(a) a chassis having a forward portion and a rear portion;

(b) first and second rotatably-mounted driving elements having treads thereon, said driving elements carried by the chassis in laterally spaced-apart relation to each other for driving and steering the chassis along a ground surface, said first and second driving elements defining a centrally-disposed excavation work area therebetween;

(c) an excavating auger rotatably-mounted on the chassis in the excavation work area forwardly of the rear portion of the chassis, rearwardly of the forward portion of the chassis and intermediate the first and second driving elements for penetrating the ground surface and excavating a ditch therein; and (d) auger positioning means carried by the chassis and connected to said auger for moving said auger laterally in a continuous path between said first and second driving elements to permit adjustment of the position of the auger in relation to the first and second driving elements.

2. A continuous ditch excavator according to claim 1, wherein said auger defines a pivot point about which the chassis is adapted to pivot to control the direction of ditch excavation.

3. A continuous ditch excavator according to claim 1, wherein a containment bin is mounted on the chassis in proximity to the auger for receiving soil removed from the ground by the auger.

4. A continuous ditch excavator according to claim 3, wherein emptying means are provided adjacent to the containment bin for emptying the soil in the containment bin.

5. A continuous ditch excavator according to claim 4, wherein said emptying means comprise a transport auger positioned in communication with the containment bin for moving soil out of the containment bin and depositing the soil at a soil deposit location adjacent to the ditch.

6. A continuous ditch excavator according to claim 5, wherein the transport auger extends diagonally from a location proximate the excavating auger to the soil deposit location adjacent to the ditch.

7. A continuous ditch excavator according to claim 1 or 3, and further comprising a containment shield disposed in a first plane and adjacent to the auger for preventing the soil removed by the auger from falling back into the ditch as the auger is raised out of the ditch.

8. A continuous ditch excavator according to claim 7, and further comprising a second containment shield disposed in a second plane, said first and second containment shields independently rotatable about said auger and cooperatively positioned to expose a desired area of said auger to the soil to be excavated.

9. A continuous ditch excavator according to claim 8, wherein said containment shields cooperate with each other to enclose two-thirds of the circumference of the auger.

10. A continuous ditch excavator according to claim 7, and further comprising a stabilizing bar connected at opposing ends to said containment shield and said auger to stabilize the auger and prevent contact between the auger and the containment shield.

11. A continuous ditch excavator according to claim 7, wherein said containment shield includes a first shield component proximate a ground penetrating portion of the auger and the rear portion of the chassis, said first shield component comprising an arcuate plate partially surrounding the auger and rotatable about the auger.

12. A continuous ditch excavator according to claim 11, wherein said first shield component is positioned opposite to a direction of travel of the auger defined by lateral movement of the auger between the first and second driving elements and movement of the chassis.

13. A continuous ditch excavator according to claim 11, wherein said first shield component is semi-circular.

14. A continuous ditch excavator according to claim 11, wherein the containment shield includes a second shield component proximal to the portion of the auger that remains above ground and the forward portion of the chassis, said second shield component comprising an arcuate plate partially surrounding the auger and preventing soil from entering the forward portion of the chassis.

15. A continuous ditch excavator according to claim 11, wherein the containment shield includes a middle shield component disposed between the upper and lower shield components and completely surrounding the auger.

16. A continuous ditch excavator according to claim 1, wherein said auger positioning means permit adjustment of the position of the auger in relation to the first and second driving elements while said auger is penetrating the ground surface and excavating a ditch therein.

17. A continuous ditch excavator according to claim 1, wherein said auger positioning means comprises at least one rail and a chain assembly, wherein said auger is sildably engaged to said at least one rail and attached to the chain assembly.

18. A continuous ditch excavator, comprising:

(a) a chassis having a forward portion and a rear portion;

(b) rotatably-mounted driving elements having treads thereon, said driving elements carried by the chassis in laterally spaced-apart relation to each other for driving and steering the chassis along a ground surface, said first and second driving elements defining a centrally-disposed excavation work area therebetween;

(c) a rotatably-mounted excavating auger mounted on the chassis in the excavation work area forwardly of the rear portion of the chassis, rearwardly of the forward portion of the chassis and intermediate the first and second driving elements for penetrating and excavating a ditch in the ground as the chassis is driven along the ground, said auger defining a pivot point about which the chassis is adapted to pivot to control the direction of ditch excavation;

(d) a containment shield adjacent to the auger for preventing the soil removed by the auger from falling back into the ditch as the auger is raised out of the ditch; and (e) a stabilizing bar connected at opposing ends to the containment shield and the auger to stabilize the auger and prevent contact between the auger and the containment shield.

19. A continuous ditch excavator according to claim 18, and further comprising:

(a) a containment bin mounted on the chassis in proximity to the excavating auger for receiving soil removed from the ground by the excavating auger; and (b) a transport auger positioned in communication with the containment bin for moving soil out of the containment bin and depositing the soil at a soil deposit location adjacent to the ditch.

20. A continuous ditch excavator according to claim 19, wherein said transport auger extends diagonally from a location proximate the excavating auger to the soil deposit location adjacent to the ditch.

21. A continuous ditch excavator comprising:

(a) a chassis having a forward portion and a rear portion;

(b) rotatably-mounted driving elements having treads thereon, said driving elements carried by the chassis in laterally spaced-apart relation to each other for driving and steering the chassis along a ground surface, said first and second driving elements defining a centrally-disposed excavation work area therebetween;

(c) a first auger rotatably mounted on the chassis in the excavation work area forwardly of the rear portion of the chassis, rearwardly of the forward portion of the chassis and intermediate the first and second driving elements for penetrating a ground surface and excavating a ditch in the ground as the chassis is driven along the ground surface, said first auger defining a pivot point about which the chassis is adapted to pivot to control the direction of ditch excavation;

(d) a second auger positioned on the chassis proximate the first auger for moving soil removed from the ground by the first auger to a point outside of the excavator.

22. A continuous ditch excavator according to claim 21, wherein said first auger is positioned vertically, and said second auger is positioned horizontally.

23. A continuous ditch excavator according to claim 21, and further comprising a containment bin mounted on the chassis in proximity to the first auger for receiving soil removed from the ground by the first auger, and wherein said second auger is positioned in communication with the containment bin for moving soil out of the containment bin and depositing the soil at a soil deposit location adjacent to the ditch.

* * * * *